US011484769B2

(12) United States Patent
Mackey et al.

(10) Patent No.: US 11,484,769 B2
(45) Date of Patent: Nov. 1, 2022

(54) LEG PADS FOR A HOCKEY GOALKEEPER

(71) Applicant: BAUER HOCKEY, LLC, Exeter, NH (US)

(72) Inventors: Lee Mackey, Prévost (CA); Guillaume Harvey, Verdun (CA); Alexandre Du Ruisseau, Laval (CA)

(73) Assignee: BAUER HOCKEY, LLC, Exeter, NH (US)

( * ) Notice: Subject to any disclaimer, the term of this patent is extended or adjusted under 35 U.S.C. 154(b) by 520 days.

(21) Appl. No.: 16/531,438

(22) Filed: Aug. 5, 2019

(65) Prior Publication Data

US 2019/0351312 A1 Nov. 21, 2019

Related U.S. Application Data

(63) Continuation of application No. 14/521,120, filed on Oct. 22, 2014, now abandoned, which is a (Continued)

(30) Foreign Application Priority Data

Jan. 15, 2014 (CA) ..... CA 2839893
Mar. 14, 2014 (CA) ..... CA 2847132

(51) Int. Cl.
*A63B 71/12* (2006.01)
*A63B 69/00* (2006.01)
(Continued)

(52) U.S. Cl.
CPC ..... *A63B 71/1225* (2013.01); *A63B 69/0026* (2013.01); *A41D 13/0543* (2013.01); *A63B 2102/24* (2015.10)

(58) Field of Classification Search
CPC ..... A63B 71/1225; A63B 69/0026; A63B 2102/24; A41D 13/065
See application file for complete search history.

(56) References Cited

U.S. PATENT DOCUMENTS 2,733,443 A 2/1956 Holder
3,446,880 A 5/1969 Enicks
(Continued)

FOREIGN PATENT DOCUMENTS

CA 2839893 9/2014
CA 2847132 8/2019
(Continued)

OTHER PUBLICATIONS

European search report and written opinion dated Jun. 20, 2014 in connection with European Patent Application No. 14160313.4, 5 pages.

(Continued)

*Primary Examiner* — Katherine M Moran

(57) ABSTRACT

A leg pad for a hockey goalkeeper playing hockey (e.g., ice hockey) is provided. The leg pad comprises a frontal portion, a medial portion, and a lateral portion respectively configured to be positioned adjacent to a front, a medial side, and a lateral side of a goalkeeper's leg when the leg pad is worn on the leg. The leg pad comprises an outer shell comprising an outer surface of the leg pad, an inner liner for facing the leg, and protective padding disposed between the molded outer shell and the inner liner. The outer shell may comprise molded foam.

33 Claims, 20 Drawing Sheets

Related U.S. Application Data continuation-in-part of application No. 14/212,518, filed on Mar. 14, 2014, now abandoned.

(60) Provisional application No. 61/794,504, filed on Mar. 15, 2013.

(51) Int. Cl.
*A41D 13/05* (2006.01)
*A63B 102/24* (2015.01)

(56) References Cited

U.S. PATENT DOCUMENTS

| | | | | |
|---|---|---|---|---|
| 3,761,960 | A | 10/1973 | Woodcock | |
| 3,772,704 | A * | 11/1973 | Carbonneau | A63B 71/1225 2/22 |
| 3,877,077 | A * | 4/1975 | Chapdelaine | A63B 71/1225 2/22 |
| 4,868,926 | A * | 9/1989 | Lowson | A63B 71/1225 2/22 |
| 5,093,931 | A | 3/1992 | LaBerge et al. | |
| 5,301,370 | A * | 4/1994 | Henson | A63B 71/1225 2/22 |
| 5,477,558 | A | 12/1995 | Volker et al. | |
| 5,617,850 | A | 4/1997 | Pontzer | |
| 6,178,556 | B1 | 1/2001 | Foreman et al. | |
| 6,560,781 | B1 * | 5/2003 | Keene | A63B 71/1225 2/22 |
| 6,709,729 | B2 | 3/2004 | Baruch | |
| 6,964,062 | B1 | 11/2005 | Chen | |
| 7,464,414 | B2 | 12/2008 | McDuff | |
| 7,823,218 | B2 | 11/2010 | Goyer et al. | |
| 8,161,569 | B2 | 4/2012 | Hudon et al. | |
| 8,261,369 | B2 * | 9/2012 | Sioui | A63B 71/1225 2/22 |
| 9,198,471 | B2 * | 12/2015 | Behrend | A63B 71/1225 |
| 9,440,136 | B2 * | 9/2016 | Smith | A43B 5/18 |
| 2004/0181850 | A1 * | 9/2004 | Beland | A41D 13/08 2/220 |
| 2005/0015841 | A1 | 1/2005 | Hoffman | |
| 2007/0250965 | A1 | 10/2007 | Sioul et al. | |
| 2007/0250977 | A1 | 11/2007 | Brown et al. | |
| 2008/0078007 | A1 * | 4/2008 | Lefebvre | A63B 71/1225 2/22 |
| 2008/0120756 | A1 | 5/2008 | Shepherd | |
| 2008/0201814 | A1 * | 8/2008 | Goyer | A41D 13/0543 2/22 |
| 2009/0025114 | A1 | 1/2009 | Hudon et al. | |
| 2009/0077703 | A1 | 3/2009 | Gabry et al. | |
| 2012/0255096 | A1 | 10/2012 | Wesley | |
| 2013/0167291 | A1 | 7/2013 | Skottheim et al. | |
| 2013/0312152 | A1 * | 11/2013 | Paul | A41D 13/015 2/16 |
| 2013/0318675 | A1 * | 12/2013 | Mackey | A63B 71/1225 2/22 |
| 2014/0123361 | A1 * | 5/2014 | Gudalis | A41D 13/0156 2/22 |
| 2014/0259261 | A1 * | 9/2014 | Mackey | A63B 71/1225 2/22 |
| 2015/0033433 | A1 * | 2/2015 | Mackey | A63B 69/0026 2/22 |

FOREIGN PATENT DOCUMENTS

| | | |
|---|---|---|
| EP | 1886717 | 6/2012 |
| WO | 1996023556 | 8/1996 |

OTHER PUBLICATIONS

Office Action dated Jul. 1, 2015 in connection with European Patent Application No. 14160313.4, 4 pages.
Examiner's Report dated Feb. 22, 2016 in connection with Canadian Patent Application No. 2839893, 5 pages.
Examiner's Report dated Mar. 7, 2016 in connection with Canadian Patent Application No. 2847132, 4 pages.
Non-Final Office Action dated May 27, 2016 in connection with U.S. Appl. No. 14/212,518, 14 pages.
Non-Final Office Action dated Oct. 18, 2016 in connection with U.S. Appl. No. 14/521,120, 12 pages.
Final Office Action dated Dec. 29, 2016 in connection with U.S. Appl. No. 14/212,518, 10 pages.
Examiner's Report dated Feb. 21, 2017 in connection with Canadian Patent Application No. 2847132, 4 pages.
Final Office Action dated Apr. 28, 2017 in connection with U.S. Appl. No. 14/521,120, 10 pages.
Non-Final Office Action dated Jun. 9, 2017 in connection with U.S. Appl. No. 14/212,518, 17 pages.
Non-Final Office Action dated Oct. 27, 2017 in connection with U.S. Appl. No. 14/521,120, 9 pages.
Final Office Action dated Mar. 15, 2018 in connection with U.S. Appl. No. 14/212,518, 19 pages.
Final Office Action dated Mar. 15, 2018 in connection with U.S. Appl. No. 14/521,120, 11 pages.
Examiner's Report dated Jul. 6, 2018 in connection with Canadian Patent Application No. 2839893, 4 pages.
Non-Final Office Action dated Aug. 9, 2018 in connection with U.S. Appl. No. 14/521,120, 6 pages.
Non-Final Office Action issued by the USPTO dated Aug. 14, 2018 in connection with U.S. Appl. No. 14/212,518, 7 pages.
Final Office Action issued by the USPTO dated Feb. 21, 2019 in connection with U.S. Appl. No. 14/212,518—16 pages.
Final Office Action issued by the USPTO dated Mar. 5, 2019 in connection with U.S. Appl. No. 14/521,120—15 pages.
Non-Final Office Action issued by the USPTO dated Aug. 14, 2019 in connection with U.S. Appl. No. 14/212,518—22 pages.
Final Office Action issued by the USPTO dated Apr. 15, 2020 in connection with U.S. Appl. No. 14/212,518—22 pages.

* cited by examiner

LEG PADS FOR A HOCKEY GOALKEEPER

CROSS-REFERENCE TO RELATED APPLICATION

This application claims the benefit under 35 USC 120 and is a continuation of U.S. patent application Ser. No. 14/521,120, filed on Oct. 22, 2014, now abandoned, and hereby incorporated by reference herein, which is a continuation-in-part of U.S. patent application Ser. No. 14/212,518 filed on Mar. 14, 2014 and hereby incorporated by reference herein, and claims priority from U.S. Provisional Patent Application No. 61/794,504, filed on Mar. 15, 2013 now abandoned, and hereby incorporated by reference herein.

FIELD OF THE INVENTION

The invention relates generally to protective hockey equipment and, more particularly, to leg pads for hockey goalkeepers.

BACKGROUND

Leg pads are worn by hockey goalkeepers to protect their legs against impacts from pucks, balls, hockey sticks or other objects and/or to protect their legs when moving (e.g., dropping) them onto a playing surface.

A hockey goalkeeper's leg pad typically comprises protective padding for providing padded protection to the goalkeeper's leg and an outer covering disposed over the protective padding. The outer covering is typically made of one or more panels of synthetic pliable material such as synthetic leather (e.g., polyurethane (PU) leather) or fabric (e.g., nylon fabric, polyester fabric, Cordura™ fabric, etc.) that are cut into a desired configuration so as to cover the protective padding.

The synthetic leather or fabric used for a leg pad's outer covering may have some drawbacks. For example, in some cases, the synthetic leather or fabric may be limited in its ability to provide protection in and of itself and/or may require additional components to be added to the leg pad, such as fabric overlays for decoration and/or separate panels for attaching straps of the leg pad.

For these and other reasons, there is a need for improvements in a hockey goalkeeper's leg pads.

SUMMARY OF THE INVENTION

According to an aspect of the invention, there is provided a leg pad for a hockey goalkeeper. The leg pad is wearable on a leg of the hockey goalkeeper to protect the leg. The leg pad comprises a frontal portion, a medial portion, and a lateral portion respectively configured to be positioned adjacent to a front, a medial side, and a lateral side of the leg when the leg pad is worn on the leg. The leg pad comprises a molded outer shell comprising an outer surface of the leg pad, an inner liner for facing the leg, and protective padding disposed between the molded outer shell and the inner liner.

According to another aspect of the invention, there is provided a leg pad for a hockey goalkeeper. The leg pad is wearable on a leg of the hockey goalkeeper to protect the leg. The leg pad comprises a frontal portion, a medial portion, and a lateral portion respectively configured to be positioned adjacent to a front, a medial side, and a lateral side of the leg when the leg pad is worn on the leg. The leg pad comprises an outer shell comprising an outer surface of the leg pad. The outer shell comprises molded foam. The leg pad comprises an inner liner for facing the leg and protective padding disposed between the outer shell and the inner liner.

According to another aspect of the invention, there is provided a leg pad for a hockey goalkeeper. The leg pad is wearable on a leg of the hockey goalkeeper to protect the leg. The leg pad comprises a frontal portion, a medial portion, and a lateral portion respectively configured to be positioned adjacent to a front, a medial side, and a lateral side of the leg when the leg pad is worn on the leg. The leg pad comprises a molded outer shell comprising an outer surface of the leg pad. The molded outer shell comprises an upper leg portion, a knee portion, and a lower leg portion. The molded outer shell has a molded bent configuration such that the molded outer shell is bent in a longitudinal direction of the leg pad. The leg pad comprises an inner liner for facing the leg and protective padding disposed between the molded outer shell and the inner liner.

According to another aspect of the invention, there is provided a leg pad for a hockey goalkeeper. The leg pad is wearable on a leg of the hockey goalkeeper to protect the leg. The leg pad comprises a frontal portion, a medial portion, and a lateral portion respectively configured to be positioned adjacent to a front, a medial side, and a lateral side of the leg when the leg pad is worn on the leg. The leg pad comprises an outer shell comprising an outer surface of the leg pad. The outer shell comprises: molded foam' and a skin affixed to the molded foam and constituting at least part of the outer surface of the leg pad. The leg pad comprises: an inner liner for facing the leg; and protective padding disposed between the outer shell and the inner liner.

According to another aspect of the invention, there is provided a leg pad for a hockey goalkeeper. The leg pad is wearable on a leg of the hockey goalkeeper to protect the leg. The leg pad comprises a frontal portion, a medial portion, and a lateral portion respectively configured to be positioned adjacent to a front, a medial side, and a lateral side of the leg when the leg pad is worn on the leg. The leg pad comprises: an outer shell comprising an outer surface of the leg pad; a molded inner liner for facing the leg; and protective padding disposed between the outer shell and the molded inner liner.

According to another aspect of the invention, there is provided a leg pad for a hockey goalkeeper. The leg pad is wearable on a leg of the hockey goalkeeper to protect the leg. The leg pad comprises a frontal portion, a medial portion, and a lateral portion respectively configured to be positioned adjacent to a front, a medial side, and a lateral side of the leg when the leg pad is worn on the leg. The leg pad comprises: an outer shell comprising an outer surface of the leg pad; a molded calf wing; an inner liner for facing the leg; and protective padding disposed between the outer shell and the inner liner.

According to another aspect of the invention, there is provided a leg pad for a hockey goalkeeper. The leg pad is wearable on a leg of the hockey goalkeeper to protect the leg. The leg pad comprises a frontal portion, a medial portion, and a lateral portion respectively configured to be positioned adjacent to a front, a medial side, and a lateral side of the leg when the leg pad is worn on the leg. The leg pad comprises: an outer shell comprising an outer surface of the leg pad; a molded knee wing; an inner liner for facing the leg; and protective padding disposed between the outer shell and the inner liner.

According to another aspect of the invention, there is provided a leg pad for a hockey goalkeeper. The leg pad is wearable on a leg of the hockey goalkeeper to protect the leg. The leg pad comprises a frontal portion, a medial portion, and a lateral portion respectively configured to be positioned adjacent to a front, a medial side, and a lateral side of the leg when the leg pad is worn on the leg. The leg pad comprises: an outer shell comprising an outer surface of the leg pad; an inner liner for facing the leg; and protective padding disposed between the outer shell and the inner liner. The protective padding comprises a plurality of padding materials that are different from one another. The padding materials are disposed relative to one another to control a rebound effect in different areas of the protective padding.

According to another aspect of the invention, there is provided a leg pad for a hockey goalkeeper. The leg pad is wearable on a leg of the hockey goalkeeper to protect the leg. The leg pad comprises a frontal portion, a medial portion, and a lateral portion respectively configured to be positioned adjacent to a front, a medial side, and a lateral side of the leg when the leg pad is worn on the leg. The leg pad comprises: an outer shell comprising an outer surface of the leg pad; an inner liner for facing the leg; and protective padding disposed between the outer shell and the inner liner. The protective padding comprises a plurality of padding materials that are different from one another. A first one of the padding materials is disposed in at least one limited area of the protective padding on a second one of the padding materials.

According to another aspect of the invention, there is provided a leg pad for a hockey goalkeeper. The leg pad is wearable on a leg of the hockey goalkeeper to protect the leg. The leg pad comprises a frontal portion, a medial portion, and a lateral portion respectively configured to be positioned adjacent to a front, a medial side, and a lateral side of the leg when the leg pad is worn on the leg. The leg pad comprises: an outer shell comprising an outer surface of the leg pad; an inner liner for facing the leg; and protective padding disposed between the outer shell and the inner liner. The protective padding comprises: a lower leg padding portion; and a foot padding portion separate from the lower leg padding portion and assembled with the lower leg padding portion during manufacturing of the leg pad.

According to another aspect of the invention, there is provided a method of customizing a leg pad for a hockey goalkeeper. The leg pad is wearable on a leg of the hockey goalkeeper to protect the leg. The leg pad comprises a frontal portion, a medial portion, and a lateral portion respectively configured to be positioned adjacent to a front, a medial side, and a lateral side of the leg when the leg pad is worn on the leg. The leg pad comprises an outer shell comprising an outer surface of the leg pad. The outer shell comprises a first material. The leg pad comprises: an inner liner for facing the leg; and protective padding disposed between the outer shell and the inner liner. The method comprises: obtaining a second material different from the first material to create a desired design for the outer surface of the leg pad; and bonding the second material to the first material to implement the desired design for the outer surface of the leg pad.

According to another aspect of the invention, there is provided a leg pad for a hockey goalkeeper. The leg pad is wearable on a leg of the hockey goalkeeper to protect the leg. The leg pad comprises a frontal portion, a medial portion, and a lateral portion respectively configured to be positioned adjacent to a front, a medial side, and a lateral side of the leg when the leg pad is worn on the leg. The leg pad comprises: a molded outer shell comprising an outer surface of the leg pad; an inner liner for facing the leg; and protective padding disposed between the molded outer shell and the inner liner. The protective padding generally conforms to the molded outer shell.

According to another aspect of the invention, there is provided a leg pad for a hockey goalkeeper. The leg pad is wearable on a leg of the hockey goalkeeper to protect the leg. The leg pad comprises a frontal portion, a medial portion, and a lateral portion respectively configured to be positioned adjacent to a front, a medial side, and a lateral side of the leg when the leg pad is worn on the leg. The leg pad comprises a molded outer shell comprising an outer surface of the leg pad. The molded outer shell comprises an upper leg portion, a knee portion, and a lower leg portion. The molded outer shell has a molded bent configuration such that the molded outer shell is bent in a longitudinal direction of the leg pad. The leg pad comprises an inner liner for facing the leg and protective padding disposed between the molded outer shell and the inner liner. The protective padding has a bent configuration such that the protective padding is bent in the longitudinal direction of the leg pad in accordance with the molded bent configuration of the molded outer shell.

According to another aspect of the invention, there is provided a leg pad for a hockey goalkeeper. The leg pad is wearable on a leg of the hockey goalkeeper to protect the leg. The leg pad comprises a frontal portion, a medial portion, and a lateral portion respectively configured to be positioned adjacent to a front, a medial side, and a lateral side of the leg when the leg pad is worn on the leg. The leg pad comprises an outer shell comprising an outer surface of the leg pad. The outer shell comprises molded material having a bent configuration such that the outer shell is bent in a longitudinal direction of the leg pad. The leg pad comprises an inner liner for facing the leg and protective padding disposed between the outer shell and the inner liner. The protective padding comprises: a first padding material; and a second padding material that is stiffer than the first padding material and that is bent in the longitudinal direction of the leg pad in accordance with the bent configuration of the molded material.

These and other aspects of the invention will now become apparent to those of ordinary skill in the art upon review of the following description of embodiments of the invention in conjunction with the accompanying drawings.

BRIEF DESCRIPTION OF THE DRAWINGS

A detailed description of embodiments of the invention is provided below, by way of example only, with reference to the accompanying drawings, in which.

The description and drawings are only for the purpose of illustrating certain embodiments of the invention and are an aid for understanding. They are not intended to be a definition of the limits of the invention.

DETAILED DESCRIPTION OF EMBODIMENTS

FIGS. 1 to 6 show an example of leg pads $\mathbf{10}_1$, $\mathbf{10}_2$ wearable by a hockey goalkeeper in accordance with an embodiment of the invention. The leg pads $\mathbf{10}_1$, $\mathbf{10}_2$ are worn on the hockey goalkeeper's legs $\mathbf{16}_1$, $\mathbf{16}_2$ while playing hockey to protect the legs $\mathbf{16}_1$, $\mathbf{16}_2$ against an impact from a puck, ball, hockey stick or other object and/or to protect the legs $\mathbf{16}_1$, $\mathbf{16}_2$ when moving (e.g., dropping) them onto a playing surface 12. In this embodiment, a type of hockey played is ice hockey such that the leg pads $\mathbf{10}_1$, $\mathbf{10}_2$ are ice hockey goalkeeper leg pads, the hockey goalkeeper is an ice hockey goalkeeper, and the playing surface 12 is an ice playing surface.

Figure 26:
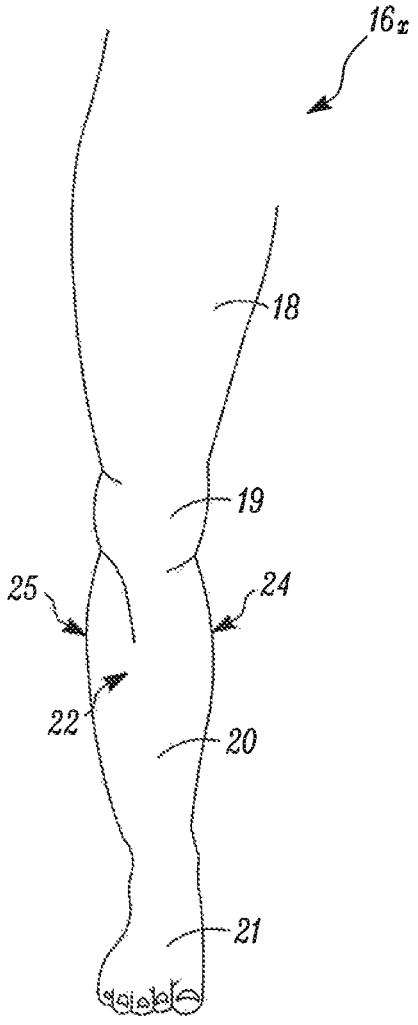
FIGS. 26 and 27 show front and side views of the goalkeeper's right leg.
Figure 27:
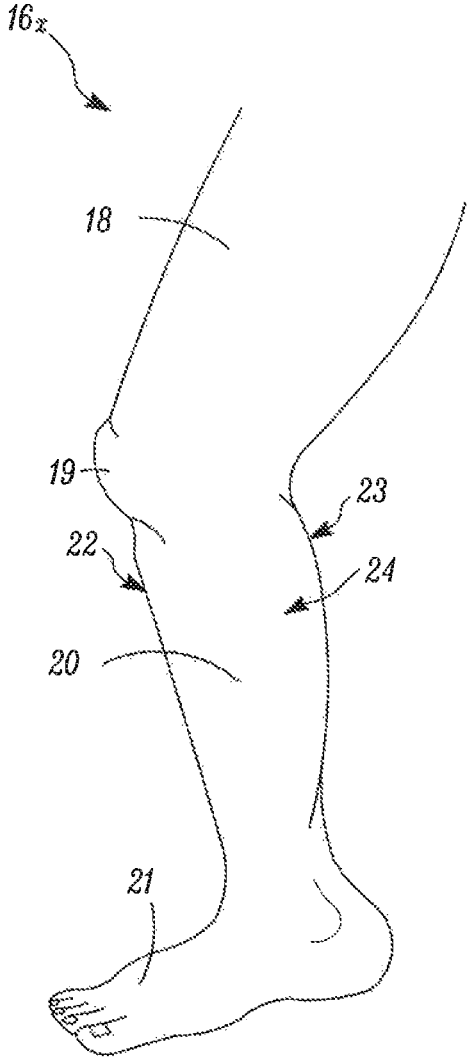

The leg pads $\mathbf{10}_1$, $\mathbf{10}_2$ protect various regions of the goalkeeper's legs $\mathbf{16}_1$, $\mathbf{16}_2$. With additional reference to FIGS. 26 and 27, each leg $\mathbf{16}_x$ of the goalkeeper comprises an upper leg 18, a knee 19, a lower leg 20, and a foot 21. The upper leg 18 is above the knee 19, while the lower leg 20 is below the knee 19 and above the foot 21. The leg $\mathbf{16}_x$ of the goalkeeper has a front 22, a back 23, a medial side 24 (sometimes referred to as an "inner side"), and a lateral side 25 (sometimes referred to as an "outer side").

In this embodiment, each leg pad $\mathbf{10}_x$ comprises an upper leg portion 30, a knee portion 31, a lower leg portion 32, and a foot portion 33 respectively configured to be positioned adjacent to the upper leg 18, the knee 19, the lower leg 20, and the foot 21 of the goalkeeper's leg $\mathbf{16}_x$ when the leg pad $\mathbf{10}_x$ is worn on the leg $\mathbf{16}_x$. The upper leg portion 30 is above the knee portion 31, while the lower leg portion 32 is below the knee portion 31 and above the foot portion 33. Each of these portions of the leg pad $\mathbf{10}_x$ comprises a frontal part, a medial part, and a lateral part such that the leg pad $\mathbf{10}_x$ comprises a frontal portion 26, a medial portion 27, and a lateral portion 28 respectively configured to be positioned adjacent to the front 22, the medial side 24, and the lateral side 25 of the goalkeeper's leg $\mathbf{16}_x$ when the leg pad $\mathbf{10}_x$ is worn on the leg $\mathbf{16}_x$. The frontal portion 26 comprises a front 34 of the leg pad $\mathbf{10}_x$, the medial portion 27 comprises a medial side 35 of the leg pad $\mathbf{10}_x$, and the lateral portion 28 comprises a lateral side 36 of the leg pad $\mathbf{10}_x$. In this embodiment, the knee portion 31 comprises a knee wing 39 and the lower leg portion 32 comprises a calf wing 59.

The leg pad $\mathbf{10}_x$ can be secured to the goalkeeper's leg $\mathbf{16}_x$ in any suitable way. For example, in this embodiment, the leg pad $\mathbf{10}_x$ comprises straps $\mathbf{50}_1$-$\mathbf{50}_S$ to secure the leg pad $\mathbf{10}_x$ to the goalkeeper's leg $\mathbf{16}_x$.

Figure 1:
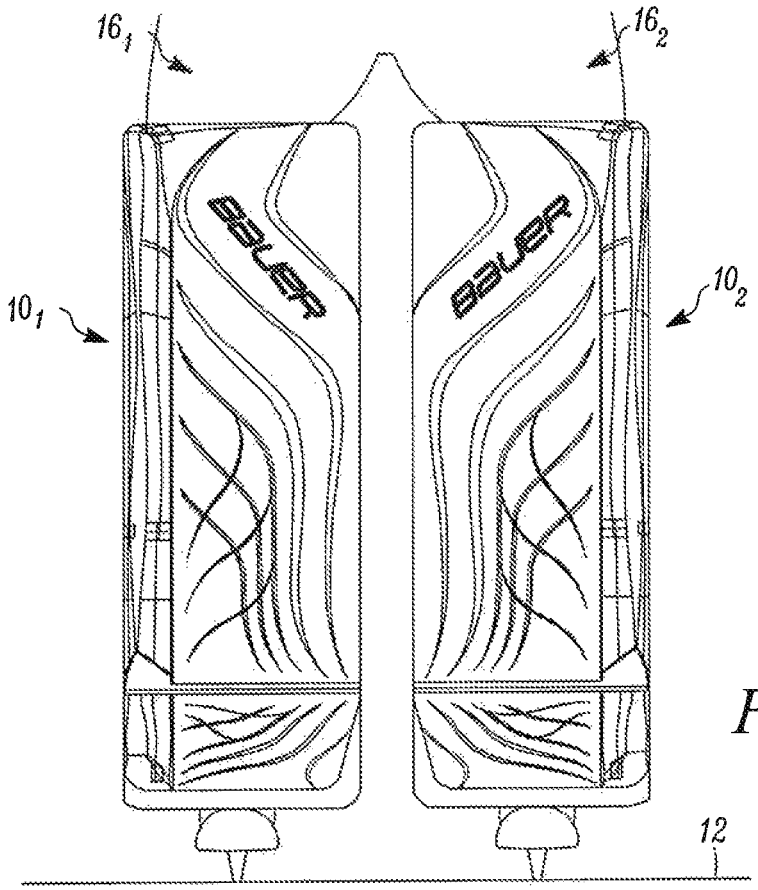
FIG. 1 shows a front view of an example of leg pads for protecting legs of a hockey goalkeeper in accordance with an embodiment of the invention.
Figure 2:
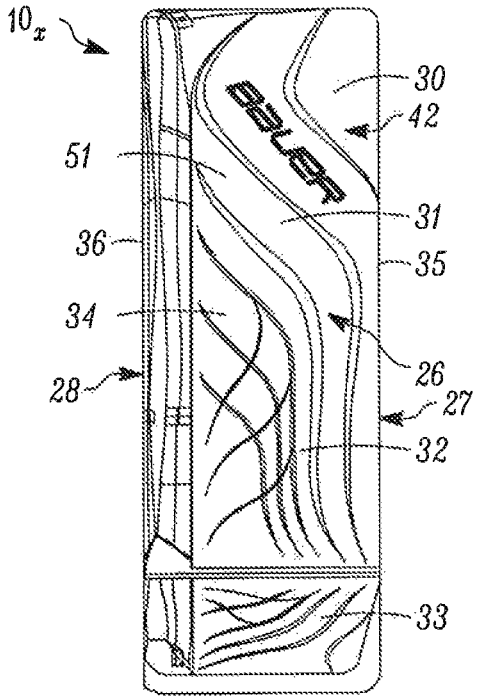
FIG. 2 shows a front view of the right leg pad.
Figure 5:
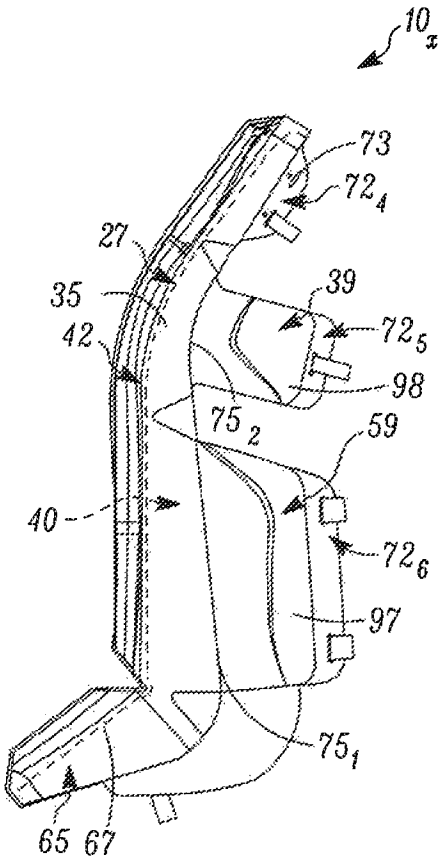
FIGS. 3 to 6 show front, side, and back views of the right leg pad with certain details omitted.
Figure 3:
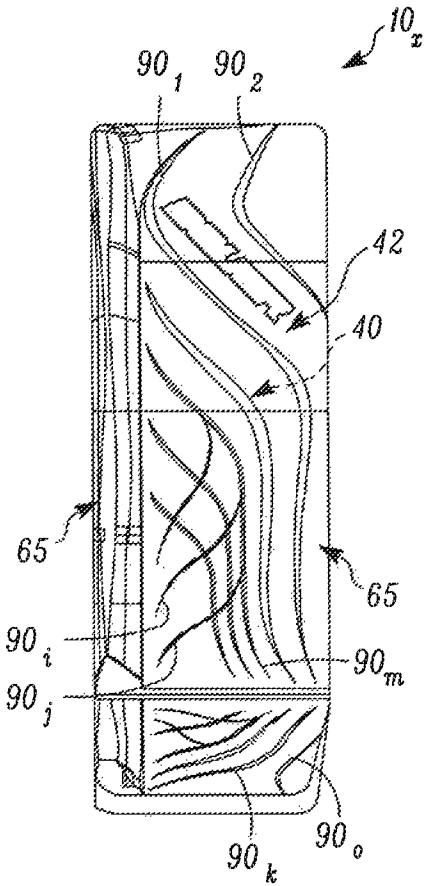
Figure 4:
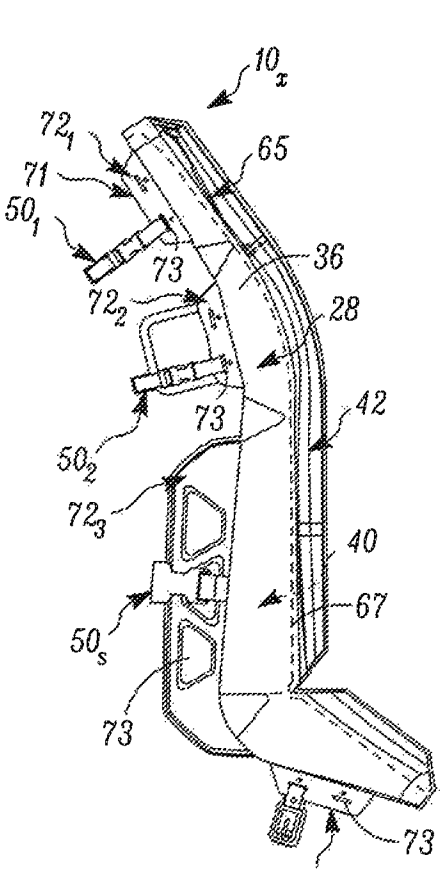
Figure 6:
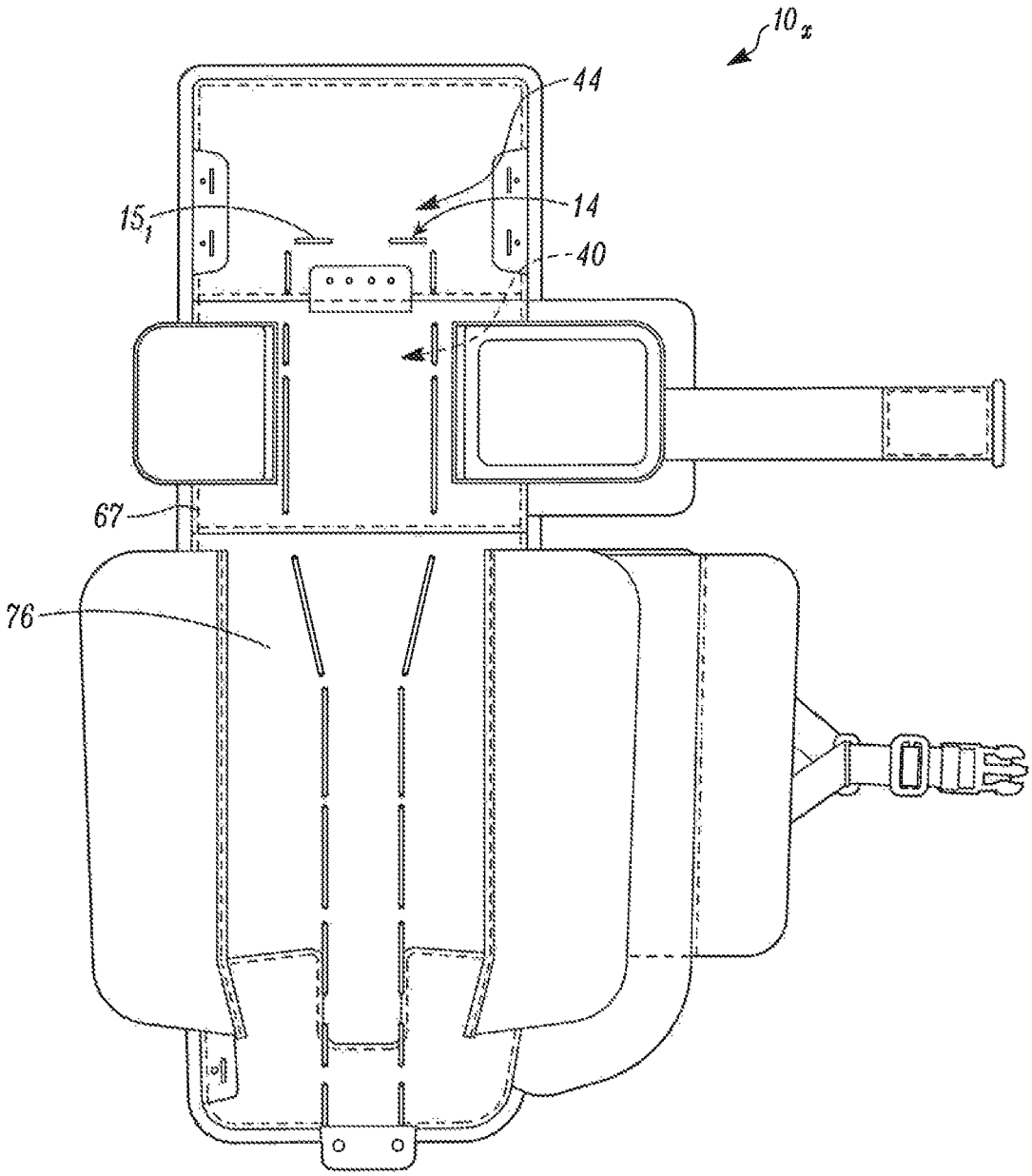
Figure 7:
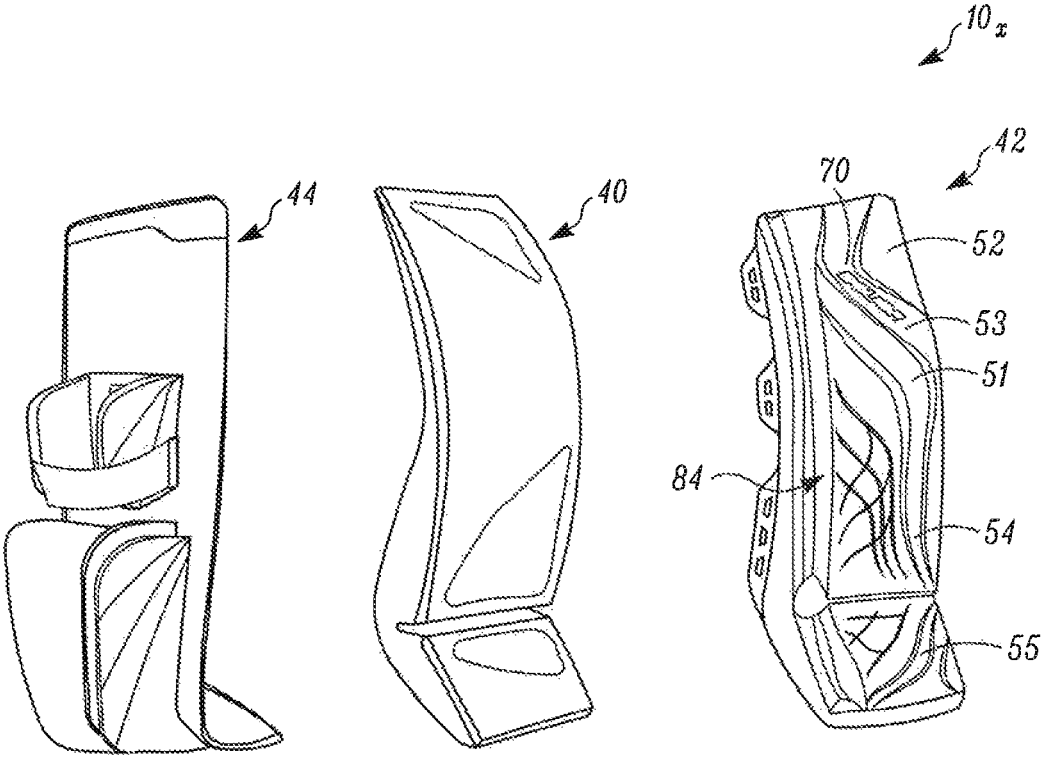
FIG. 7 shows an exploded view of certain parts of the right leg pad.
Figure 8:
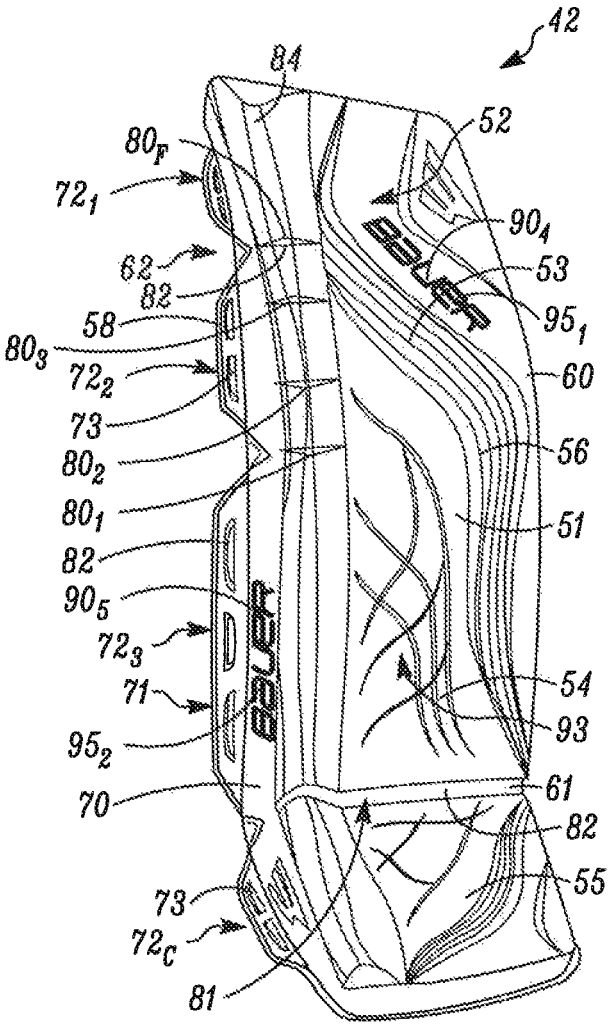
FIG. 8 shows a molded outer shell of the right leg pad.
Figure 9C:
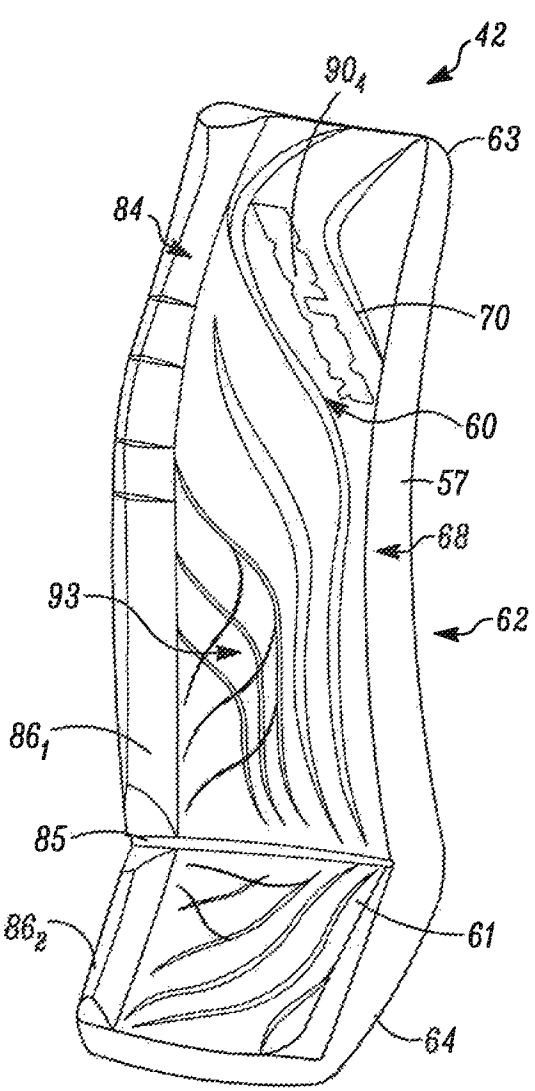
FIGS. 9A to 9D show renderings of at least part of the molded outer shell.
Figure 9A:
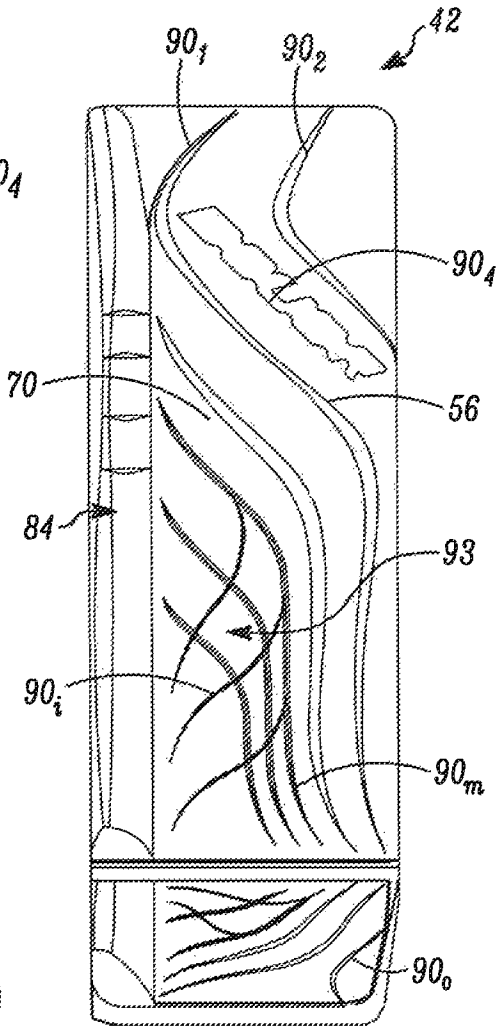
Figure 9B:
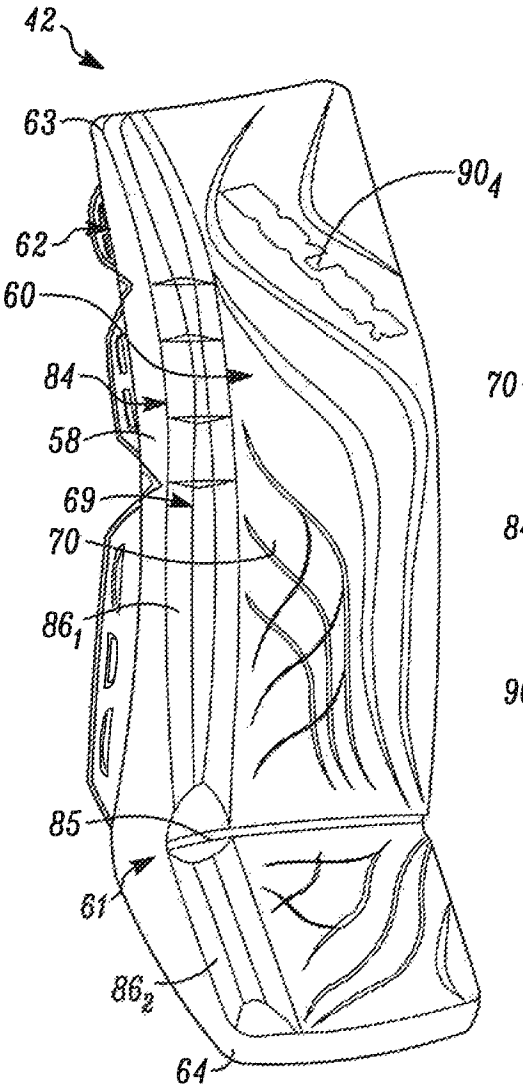
Figure 9D:
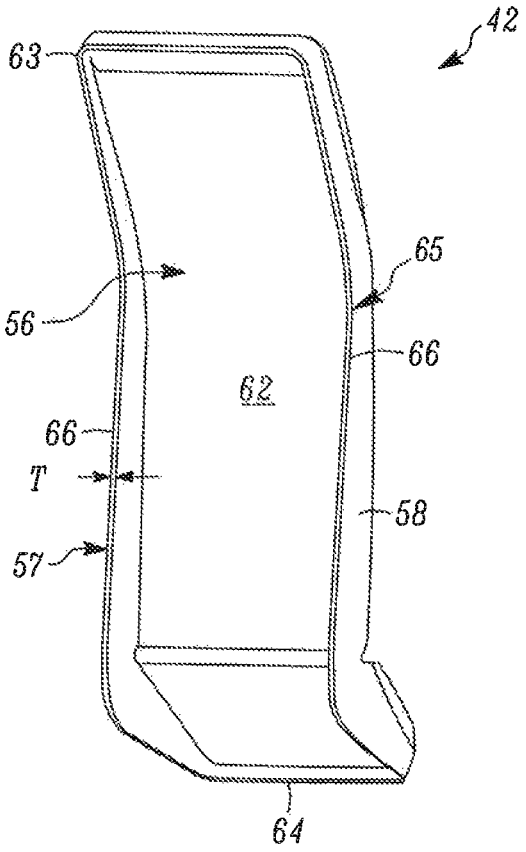

With additional reference to FIG. 7, in this embodiment, the leg pad $\mathbf{10}_x$ comprises an outer shell 42, an inner liner 44, and protective padding 40 disposed between the outer shell 42 and the inner liner 44.

The outer shell 42 comprises an outer surface 51 of the leg pad $\mathbf{10}_x$ that faces away from the goalkeeper's leg $\mathbf{16}_x$. With additional reference to FIGS. 8 and 9A to 9D, in this embodiment, the outer shell 42 comprises an upper leg portion 52, a knee portion 53, a lower leg portion 54, and a foot portion 55 which constitute respective parts of the upper leg portion 30, the knee portion 31, the lower leg portion 32, and the foot portion 33 of the leg pad $\mathbf{10}_x$. Each of these portions of the outer shell 42 comprises a frontal part, a medial part, and a lateral part such that the outer shell 42 comprises a frontal portion 56, a medial portion 57, and a lateral portion 58 which constitute respective parts of the frontal portion 26, the medial portion 27, and the lateral portion 28 of the leg pad $\mathbf{10}_x$.

In this embodiment, the outer shell 42 is a molded outer shell. That is, the outer shell 42 is formed by a molding process. A shape of the outer shell 42 is thus a molded shape imparted during the molding process. The outer shell 42 comprises molded material 70 that constitutes at least a majority (i.e., a majority or an entirety) of the outer shell 42 and has been formed during the molding process to impart the shape of the outer shell 42. More particularly, in this embodiment, the upper leg portion 52, the knee portion 53, the lower leg portion 54, and the foot portion 55 of the outer shell 42 comprise respective parts of the molded material 70 which have been configured by the molding process. Also, in this example of implementation, the outer shell 42 includes molded features for functional and/or aesthetic purposes, as further discussed later.

The molded shape of the outer shell 42 may have any suitable configuration. In this embodiment, the outer shell 42 has a molded bent configuration such that it bends in a longitudinal direction of the leg pad $\mathbf{10}_x$. More particularly, in this embodiment, the outer shell 42 includes a bend 60 in the longitudinal direction of the leg pad $\mathbf{10}_x$ between the upper leg portion 52 and the lower leg portion 54 adjacent to the knee portion 53, and a bend 61 in the longitudinal direction of the leg pad $\mathbf{10}_x$ between the lower leg portion 53 and the foot portion 55. In this example, the bend 60 is a curved part which defines a curvature of the outer shell 42, while the bend 61 is an angular part which defines an oblique angle. Also, in this embodiment, the molded bent configuration of the outer shell 42 is such that the outer shell 42 bends in a widthwise direction of the leg pad $\mathbf{10}_x$. More particularly, in this embodiment, the outer shell 42 includes a bend 68 in the widthwise direction of the leg pad $\mathbf{10}_x$ between the frontal portion 56 and the medial portion 57 of the outer shell 42, and a bend 69 in the widthwise direction of the leg pad $\mathbf{10}_x$ between the frontal portion 56 and the lateral portion 58 of the outer shell 42. The molded bent configuration of the outer shell 42 may be arranged in any other suitable way in other embodiments (e.g., include any number of bends, curved or angular, disposed in any suitable manner).

In addition, in this embodiment, the outer shell 42 comprises a cavity 62 receiving and holding the protective padding 40. The cavity 62 lies opposite the outer surface 51 of the leg pad $\mathbf{10}_x$ such that it faces the goalkeeper's leg $\mathbf{16}_x$. More particularly, in this embodiment, the medial portion 57 and the lateral portion 58 of the outer shell 42 project rearwardly relative to the frontal portion 56 of the outer shell 42 to define the cavity 62. In this example, the outer shell 42 also comprises a top portion 63 and a bottom portion 64 which project rearwardly relative to the frontal portion 56 to define the cavity 62.

Once the protective padding 40 is placed in the cavity 62 of the outer shell 42, in this embodiment, the inner liner 44 is placed behind the protective padding 40 and secured into position. To that end, in this embodiment, the outer shell 42 comprises a fastening zone 65 to fasten the outer shell 42 to at least one of the inner liner 44 and the protective padding 40. In this example, the fastening zone 65 is provided to fasten the outer shell 42 to both the inner liner 44 and the padding 40. More particularly, in this embodiment, the fastening zone 65 comprises a fastening lip 66 in at least one, in this case each, of the medial portion 57, the lateral portion 58, the top portion 63, and the bottom portion 64 of the outer shell 42. A fastener 67 interacts with the fastening lip 66 of the outer shell 42 and the inner liner 44 to secure the inner liner 44, the protective padding 40, and the outer shell 42 together. In this example, the fastener 67 is a series of stitches that stitch together the inner liner 44, the protective padding 40, and the outer shell 42. The fastener 67 may be any other suitable fastener in other examples (e.g., an adhesive, a series of staples, etc.). The fastening zone 65 may be implemented in any other suitable way in other embodiments. In addition to being retained between the outer shell 42 and the inner liner 44, in this embodiment, the protective padding 40 is also laced to the outer shell 42 and/or the inner liner 40 by a lacing arrangement 14 including laces $\mathbf{15}_1$-$\mathbf{15}_L$.

In this embodiment, the outer shell 42 has molded functional features which provide certain functions to the leg pad $\mathbf{10}_x$.

For example, in this embodiment, the outer shell 42 comprises a plurality of flexion facilitators 81, $\mathbf{80}_1$-$\mathbf{80}_F$ located at predetermined locations which are spaced from one another to facilitate flexing of the outer shell 42 at these predetermined positions when the goalkeeper's leg $\mathbf{16}_x$ moves. The flexion facilitators 81, $\mathbf{80}_1$-$\mathbf{80}_F$ are formed during the molding process of the outer shell 42. More particularly, in this embodiment, the flexion facilitator 81 is located between the lower leg portion 53 and the foot portion 55 of the outer shell 42 to facilitate flexion of the foot portion 55 relative to the lower leg portion 53 when the goalkeeper's foot 21 moves relative to his/her lower leg 20. The flexion facilitator 81 thus provides a hinge between the lower leg portion 53 and the foot portion 55 of the outer shell 42. The flexion facilitators $\mathbf{80}_1$-$\mathbf{80}_F$ are located adjacent to the upper leg portion 52 and the knee portion 53 of the outer shell 42 to facilitate flexion of the upper leg portion 52 and the knee portion 53 relative to the lower leg portion 53 when the goalkeeper's knee 19 bends. In this embodiment, each of the flexion facilitators 80, $\mathbf{80}_1$-$\mathbf{80}_F$ comprises a reduction in thickness of the outer shell 42 at its predetermined position. More particularly, in this embodiment, each of the flexion facilitators 80, $\mathbf{80}_1$-$\mathbf{80}_F$ comprises a recess 82. These localized thickness reductions tend to induce bending of the outer shell 42 at the predetermined positions of the flexion facilitators 80, $\mathbf{80}_1$-$\mathbf{80}_F$ rather than at other positions. The flexion facilitators 80, $\mathbf{80}_1$-$\mathbf{80}_F$ may be implemented in various other ways in other embodiments.

As another example, in this embodiment, the outer shell 42 comprises a strap attachment 71 for attaching the straps $\mathbf{50}_1$-$\mathbf{50}_S$ to the leg pad $\mathbf{10}_x$. The strap attachment 71 is formed during the molding process of the outer shell 42. More particularly, in this embodiment, the strap attachment 71 comprises a plurality of strap connectors $\mathbf{72}_1$-$\mathbf{72}_C$ to connect respective ones of the straps $\mathbf{50}_1$-$\mathbf{50}_S$ to the leg pad $\mathbf{10}_x$. In this example, each strap connector $\mathbf{72}_i$ comprises a strap-receiving opening 73 for receiving a given one of the straps $\mathbf{50}_1$-$\mathbf{50}_S$. A first subset of the strap connectors $\mathbf{72}_1$-$\mathbf{72}_C$ is disposed in the medial portion 57 of the outer shell 42, while a second subset of the strap connectors $\mathbf{72}_1$-$\mathbf{72}_C$ is disposed in the lateral portion 58 of the outer shell 42, such that respective ones of the strap connectors $\mathbf{72}_1$-$\mathbf{72}_C$ in the medial and lateral portions 57, 58 of the outer shell 42 are generally aligned with one another in the longitudinal direction of the leg pad $\mathbf{10}_x$ to receive corresponding ones of the straps $\mathbf{50}_1$-$\mathbf{50}_S$. The strap attachment 71 may be implemented in various other ways in other embodiments.

As yet another example, in this embodiment, the outer shell 42 comprises an edge projection 84 located in an edge region of the outer shell 42 adjacent to the lateral portion 58 of the outer shell 42. The edge projection 84 emulates a so-called "outer roll" of a conventional ice hockey goalkeeper leg pad and may help to prevent a puck from hitting the leg pad $\mathbf{10}_x$ and skipping over the leg pad $\mathbf{10}_x$ into the net. The edge projection 84 is formed during the molding process of the outer shell 42. In this example, the edge projection 84 is elongated in the longitudinal direction of the leg pad $\mathbf{10}_x$. More particularly, in this example, the edge projection 84 extends longitudinally from the upper leg portion 52 to the foot portion 55 of the outer shell 42. Also, in this example, the edge projection 84 includes a break 85 facilitating movement of a first part $\mathbf{86}_1$ of the edge projection 84 in the upper and lower leg portions 52, 54 and the knee portion 53 of the outer shell 42 relative to a second part $\mathbf{86}_2$ of the edge projection 84 in the foot portion 55 of the outer shell 42. The edge projection 84 may be implemented in various other ways in other embodiments.

As yet another example, in this embodiment, the outer shell 42 comprises a calf wing member 97 constituting at least part of the calf wing 59 of the leg pad $\mathbf{10}_x$ and a knee wing member 98 constituting at least part of the knee wing 39 of the leg pad $\mathbf{10}_x$. The calf wing member 97 and the knee wing member 98 are formed during the molding process of the outer shell 42. Hinges $\mathbf{75}_1$, $\mathbf{75}_2$ are respectively located between the calf wing member 97 and the lower leg portion 54 of the outer shell 42 and between the knee wing member 98 and the knee portion 53 of the outer shell 42. In this example, the hinges $\mathbf{75}_1$, $\mathbf{75}_2$ are formed during the molding process of the outer shell 42. More particularly, in this example, each of the hinges $\mathbf{75}_1$, $\mathbf{75}_2$ is a reduction in thickness of the outer shell 42 at its location. The calf wing member 97 and the knee wing member 98 may be implemented in various other ways in other embodiments.

Figure 10:
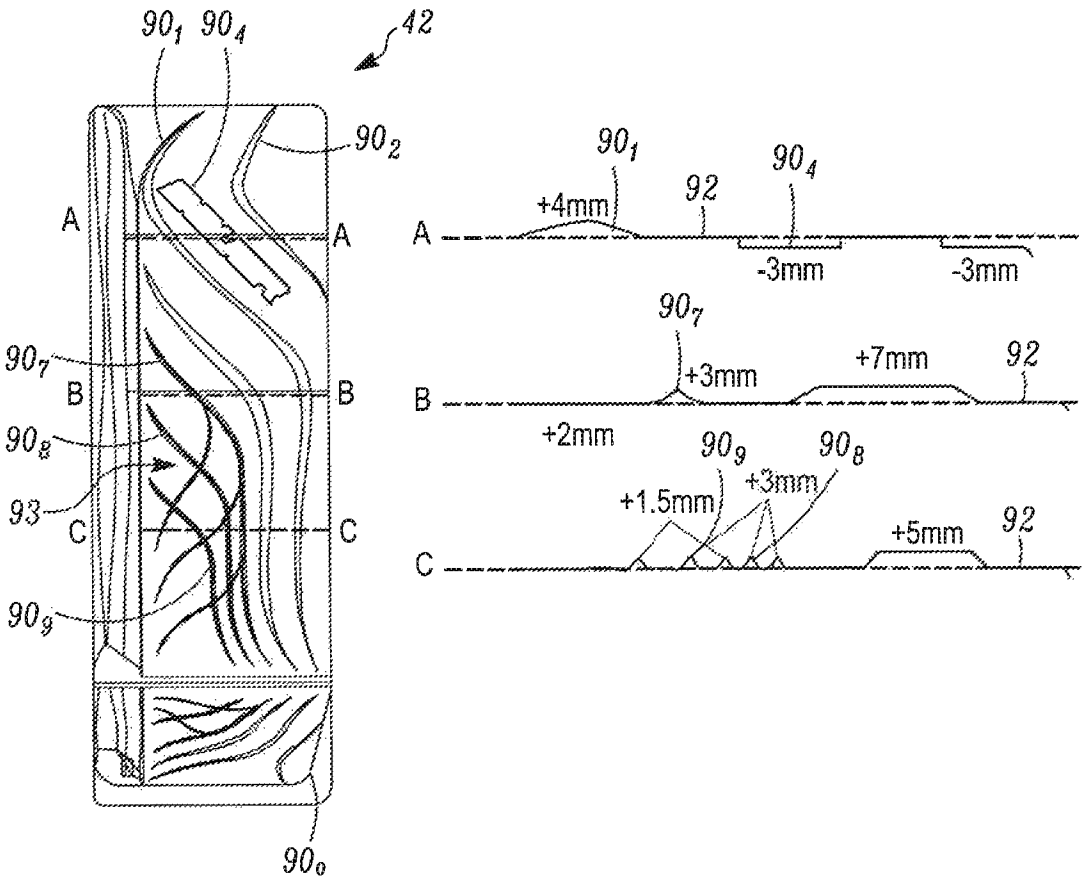
FIG. 10 shows molded ornaments of the molded outer shell.

In this embodiment, the outer shell 42 comprises a plurality of molded ornaments $\mathbf{90}_1$-$\mathbf{90}_O$ to enhance an appearance of the leg pad $\mathbf{10}_x$. The molded ornaments $\mathbf{90}_1$-$\mathbf{90}_O$ are molded relief elements that define a molded relief of the outer shell 42 which is formed during the molding process of the outer shell 42. With additional reference to FIG. 10, each of the molded ornaments $\mathbf{90}_1$-$\mathbf{90}_O$ includes a recess or projection relative to a base area 92 of the outer shell 42 which extends between and around the molded ornaments $\mathbf{90}_1$-$\mathbf{90}_O$ and which may be flat. For instance, in this example, the molded ornaments $\mathbf{90}_i$, $\mathbf{90}_j$, $\mathbf{90}_k$ are projections, while the molded ornament $\mathbf{90}_m$, is a recess, and the molded ornaments $\mathbf{90}_1$-$\mathbf{90}_O$ may have a height of at least 1.5 mm, at least 3 mm, at least 5 mm, or at least 7 mm, such that the thickness of the molded outer shell varies by at least 1.5 mm, at least 3 mm, at least 5 mm, or at least 7 mm. As they are formed during the molding process, the molded ornaments $90_1$-$90_O$ allow the leg pad $10_x$ to have an aesthetic design without requiring fabric overlays as is conventionally done in ice hockey goalkeeper leg pads.

More particularly, in this embodiment, various ones of the molded ornaments $90_1$-$90_O$ define a molded decorative pattern 93 of the outer shell 42. In this example, some of those molded ornaments $90_1$-$90_O$ defining the molded decorative pattern 93 are elongated projections (e.g., ribs) or recesses. In this case, some of those molded ornaments $90_1$-$90_O$ defining the molded decorative pattern 93 are curved and intersect other ones of these molded ornaments. The molded decorative pattern 93 may have any other suitable design in other embodiments.

Also, in this embodiment, certain ones of the molded ornaments $90_1$-$90_O$ graphically convey information to an observer of the leg pad $10_x$. For example, in this embodiment, each of the molded ornaments $90_4$, $90_5$ conveys a word (i.e., a combination of characters), in this case "BAUER", which is indicative of a brand of the leg pad $10_x$. The molded ornaments $90_1$-$90_O$ may graphically convey any other suitable information (e.g., a model name, a logo, indicia, a serial number, etc.) in other embodiments.

In addition, in this embodiment, a plurality of decorative layers $95_1$-$95_D$ may be received by given ones of the molded ornaments $90_1$-$90_O$. Each of the decorative layers $95_1$-$95_D$ may comprise a decal, a sticker, paint, or any other decorative element that can be applied to the molded material 70 of the outer shell 42. For example, in this embodiment, the molded ornaments $90_4$, $90_5$ include recesses which receive the decorative layers $95_1$, $95_2$ constituting colored words. The decorative layers $95_1$-$95_3$ may be implemented in any other suitable manner in other embodiments.

In this embodiment, the molded material 70 of the outer shell 42 comprises molded foam. This provides shock absorbability to the outer shell 42 which may help in protecting the goalkeeper's leg $16_x$. More particularly, in this embodiment, the molded foam 70 is ethylene vinyl acetate (EVA) foam. Any other suitable foam may be used in other embodiments (e.g., polyethylene foam (e.g., low-density polyethylene foam), polyurethane foam, polypropylene foam, etc.).

In some examples of implementation, the molded foam of the molded material 70 may include a single type of foam. In other examples of implementation, the molded foam of the molded material 70 may include two or more different types of foam, such as foams having different densities and/or different material compositions (e.g., an outer layer of foam that is denser than an inner layer of foam; a layer of EVA foam and another layer of polyurethane foam; etc.).

Figure 12:
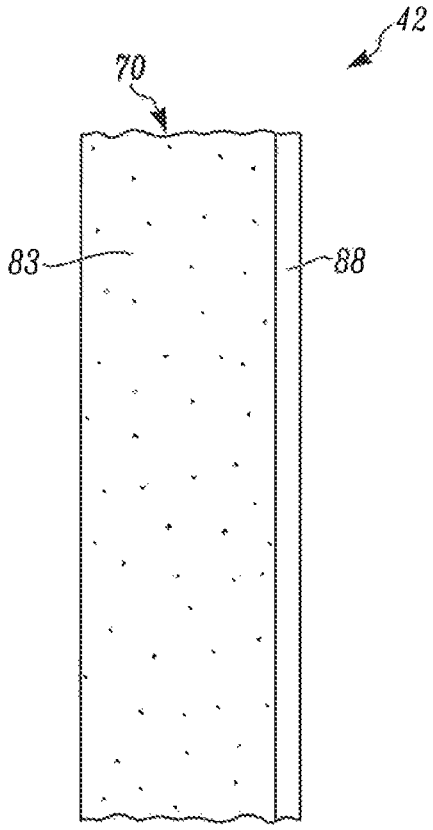
FIG. 12 shows a variant in which molded material of the molded outer shell comprises two different constituents in accordance with another embodiment of the invention.

The molded material 70 may comprise any suitable material other than foam in other embodiments (e.g., polymeric material such as thermoplastic polyurethane or any other elastomeric material, a gel, etc.). For example, in some embodiments, as shown in FIG. 12, the molded foam of the molded material 70 be a foam layer 83 and the molded material 70 may comprise a non-foam layer 88 over the foam layer 83. For instance, in some examples of implementation, the non-foam layer 88 may be thinner than the foam layer 83 and/or may have a greater resistance to wear and/or a greater resistance to rupture (i.e., to cutting or tearing) than the foam layer 83. For example, in some cases, the non-foam layer 88 may be a polyurethane layer or a layer of any other non-foam polymeric material. In this example of implementation, the non-foam layer 88 forms a skin disposed on the foam layer 83 and constituting at least part of the outer surface 51 of the leg pad $10_x$. For instance, the skin 88 may constitute at least a majority (i.e., a majority or an entirety) of the outer surface 51 of the leg pad $10_x$. In some cases, the skin 88 may be pre-laminated onto the foam layer 83, which may initially be provided as a foam sheet, before molding this foam sheet and this pre-laminated skin together as a unit.

A thickness T of the molded material 70 of the outer shell 42 may have any suitable value. For example, in some embodiments, the thickness T of the molded material 70 may be at least 4 mm, in some cases at least 5 mm, in some cases at least 6 mm, in some cases at least 7 mm, in some cases at least 8 mm, and in some cases even more (e.g., 10 mm or more). The thickness T of the molded material 70 may have any other suitable value in other embodiments. In some examples, the thickness T of the molded material 70 may be substantially constant over the outer shell 42. In other examples, the thickness T of the molded material 70 may vary such that it has different values in different regions of the outer shell 42.

The molding process of the outer shell 42 may employ any suitable molding method. In this embodiment, the molding process is compression molding such that the outer shell 42 is a compression molded outer shell. An amount of material which is to become the molded material 70 of the outer shell 42 is introduced into a mold that is initially open and then shaped into the outer shell 42 by heat and by pressure created as the mold is closed and the material is forced into contact with all mold areas. A deflashing (i.e., flash removal) operation may be performed to remove any excess material from the molding operation. The outer shell 42 may be molded using any other suitable molding method in other embodiments (e.g., injection molding, thermoforming, etc.).

The outer shell 42 may be implemented in various other ways in other embodiments. For example, in other embodiments, the outer shell 42 may not comprise any molded strap attachments such as the strap attachment 71 for attaching the straps $50_1$-$50_S$ to the leg pad $10_x$, but may rather be fastened (e.g., sewn) to a separate strap attachment (e.g., a fabric panel) to which the straps $50_1$-$50_S$ are attached. As another example, in other embodiments, flexion facilitators such as the flexion facilitators 80, $80_1$-$80_F$ may be formed after molding of the outer shell 42 (e.g., by being cut after molding). As yet another example, in some embodiments, such as in some examples mentioned above, the molded material 70 of the outer shell 42 may include two or more different constituents (e.g., two or more layers of different foams, or a foam layer and a non-foam layer).

Figure 11:
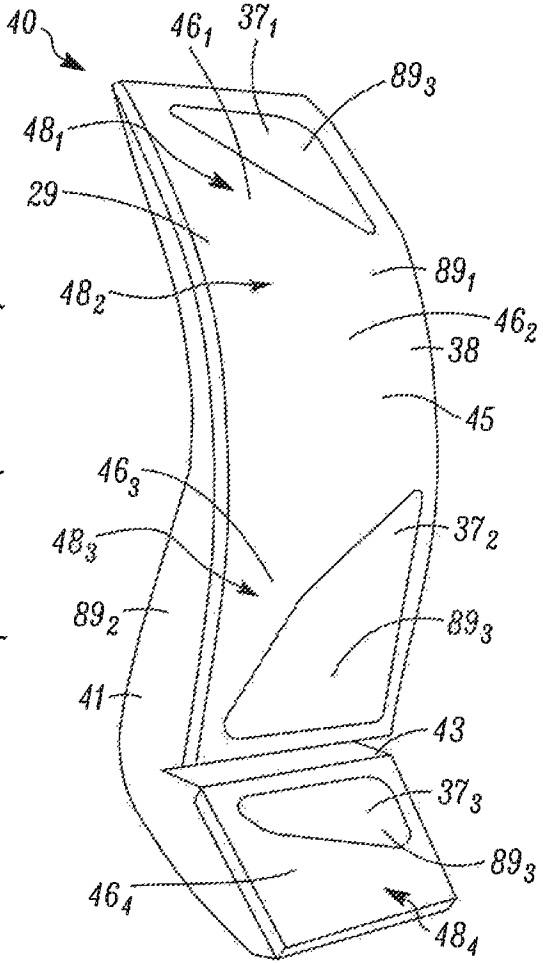
FIG. 11 shows protective padding of the right leg pad.

The protective padding 40 provides padded protection to the goalkeeper's leg $16_x$. With additional reference to FIG. 11, in this embodiment, the protective padding 40 comprises an upper leg padding portion $48_1$, a knee padding portion $48_2$, a lower leg padding portion $48_3$ and a foot padding portion $48_4$ constituting respective parts of the upper leg portion 30, the knee portion 31, the lower leg portion 32, and the foot portion 33 of the leg pad $10_x$. In this example, respective ones of the padding portions $48_1$-$48_P$ are part of a common continuous pad that extends from the upper leg portion 30 to the foot portion 33 of the leg pad $10_x$.

In this embodiment, the protective padding 40 comprises a plurality of padding materials $89_1$-$89_3$ that are different from one another. In this example, the padding materials $89_1$-$89_3$ are different types foam, such as polyurethane foam, ethylene vinyl acetate (EVA) foam, polypropylene (PP) foam, polyethylene (PE) foam), vinyl nitrile (VN) foam, or any other suitable foam. More particularly, in this example, the padding material $89_1$ is a type of polyethylene foam (e.g., high-density polyethylene foam), the padding material $89_2$ is a different type of polyethylene foam (e.g., low-density polyethylene foam), and the padding material $89_3$ is a polyurethane foam (e.g., Poron XRD). In other embodiments, one or more of the padding materials $89_1$-$89_3$ may be material other than foam, such as a gel or any other suitable shock-absorbing material.

More particularly, in this embodiment, the padding material $89_1$ forms an outer layer 38 of the protective padding 40 and is stiffer (e.g., denser) than the padding material $89_2$ which forms an inner layer 41 of the protective padding 40. This may impart rigidity to the protective padding 40 or enhance an impact resistance and/or a shock absorbance of the protective padding 40.

Also, in this embodiment, the padding material $89_3$ is disposed in specific limited areas $37_1$-$37_3$ of the protective padding 40 relative to the padding material $89_1$ to control a rebound effect at these areas when a puck hits these areas. For example, the goalkeeper may prefer a long rebound or a short rebound when a puck hits in a particular area and the padding material $89_3$ may be distributed to customize a puck rebound profile of the leg pad $10_x$ according to the goalkeeper's preference. For a given puck impact speed, the rebound effect is thus different in the areas $37_1$-$37_3$ of the protective padding 40 than in other areas $46_1$-$46_4$ of the protective padding 40 outside these areas $37_1$-$37_3$.

More particularly, in this embodiment, the padding material $89_1$ and the padding material $89_3$ constitute respective parts of an outer surface 45 of the protective padding 40 that faces away from the goalkeeper's leg. In this example, the areas $37_1$-$37_3$, which are spaced from one another, are respectively located in the upper leg padding portion $48_1$, the lower leg padding portion $48_3$ and the foot padding portion $48_4$ of the protective padding 40. Each of the areas $37_1$-$37_3$ is limited in that it occupies less than a width of the protective padding 40 and/or less than a length of the protective padding 40. In this case, each of the areas $37_1$-$37_3$ occupies less than 90%, here less than 80%, of the width of the protective padding 40 and less than half, here less than one-third, of the length of the protective padding 40. Also, in this example, each of the areas $37_1$-$37_3$ has a tapered configuration. More particularly, in this example, each of the areas $37_1$-$37_3$ tapers in the widthwise direction of the leg pad $10_x$.

A shape of the protective padding 40 generally conforms to the outer shell 42. In this embodiment, the protective padding 40 has a bent configuration such that it bends in the longitudinal direction of the leg pad 10, to generally conform to the molded bent configuration of the outer shell 42. More particularly, in this embodiment, the protective padding includes a bend 29 in the longitudinal direction of the leg pad $10_x$ between the upper leg padding portion $48_1$ and the lower leg padding portion $48_3$ and a bend 43 in the longitudinal direction of the leg pad $10_x$ between the lower leg padding portion $48_3$ and the foot padding portion $48_4$. In this example, the bend 29 is a curved part which defines a curvature of the protective padding 40, while the bend 43 is an angular part which defines an oblique angle. The bent configuration of the protective padding 40 may be arranged in any other suitable way in other embodiments (e.g., include any number of bends, curved or angular, disposed in any suitable manner).

The protective padding 40 may be manufactured in any suitable way. In this embodiment, the outer layer 38 of the protective padding 40, which is made of the padding material $89_1$, is molded or machined, while the inner layer 41 of the protective padding 40, which is made of the padding material $89_2$, is machined. Also, in this embodiment, the padding materials $89_1$-$89_3$ are adhesively bonded.

Any suitable adhesive may be used (e.g., Contact Cement™, Spray Glue, etc.). The padding materials $89_1$-$89_3$ may be retained together in any other suitable way in other embodiments (e.g., by being overmolded). The protective padding 40 may be made using any other suitable manufacturing methods in other embodiments.

Figure 21:
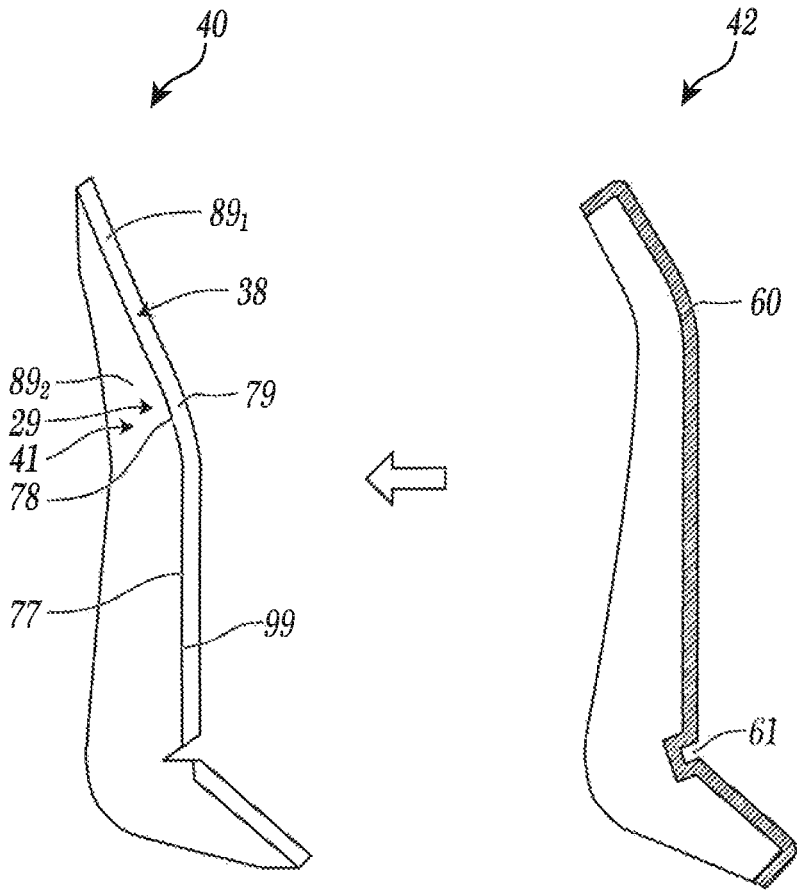
FIG. 21 shows another view of the protective padding.
Figure 22:
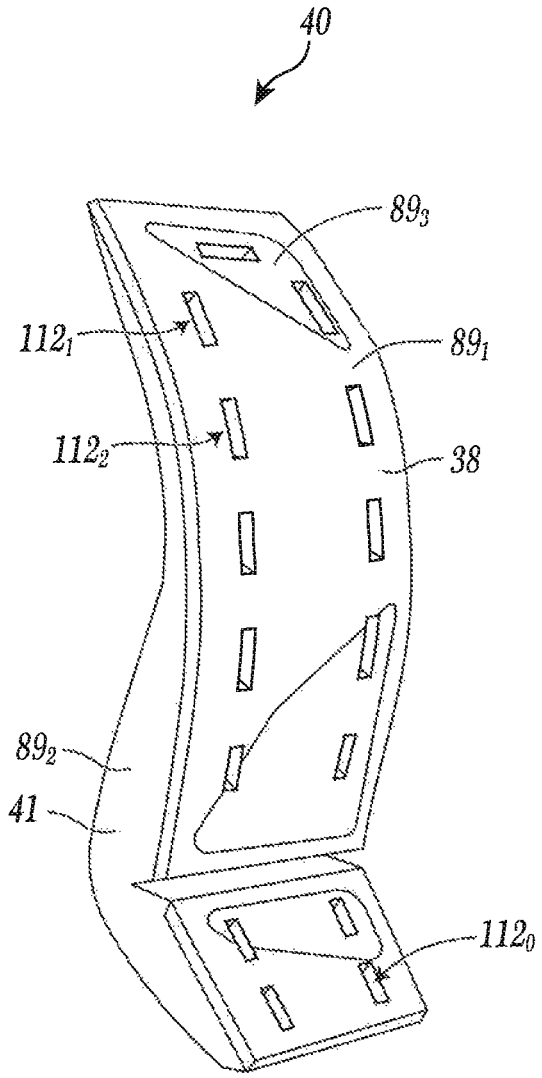
FIGS. 22 to 25 show an example of a lacing arrangement.
Figure 23:
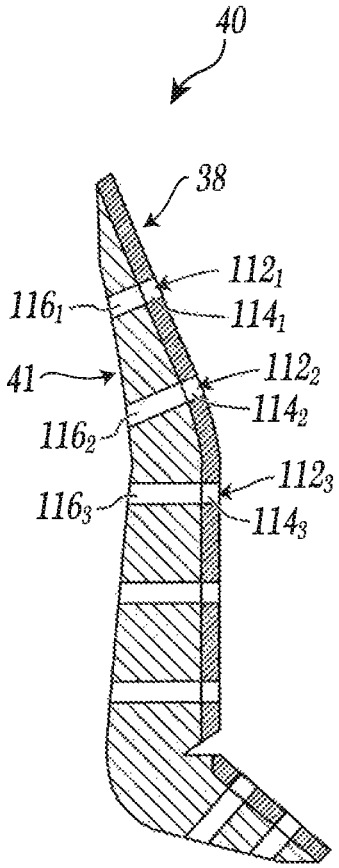
Figure 24:
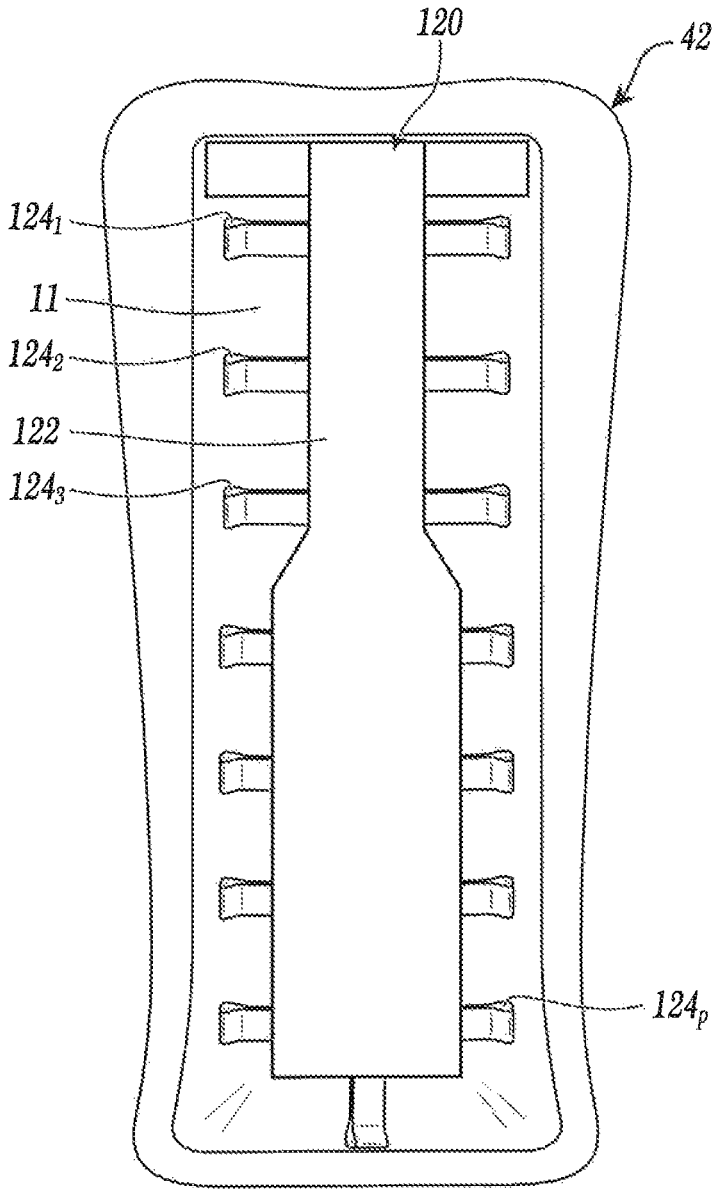
Figure 25:
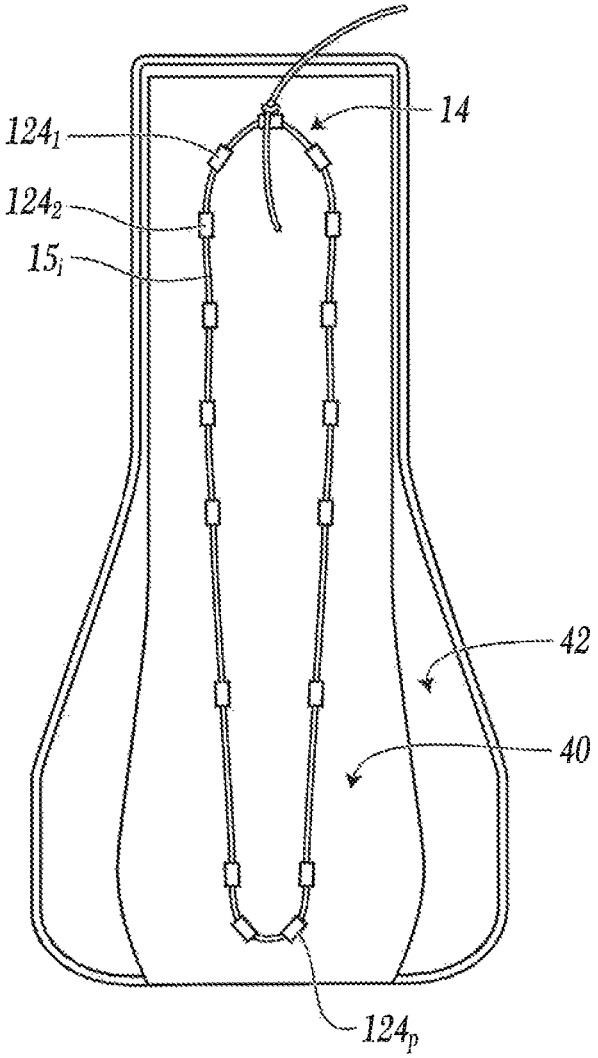

More particularly, in this embodiment, with additional reference to FIG. 21, a shape of the outer layer 38 of the protective padding 40, which is formed of the padding material $89_1$ that is stiffer than the padding material $89_2$ forming the inner layer 41 of the protective padding 40, generally conforms to the outer shell 42. This helps to position the outer shell 42 on the protective padding 40 and to properly interface them. For instance, having the outer layer 38 of the protective padding 40 generally conform to the molded shape of the outer shell 42 can avoid having to further bend, straighten, or otherwise deform the outer shell 42 and/or the outer layer 38 of the protective padding 40 when assembling the leg pad $10_x$. In other words, the outer layer 38 of the protective padding 40 is shaped to accommodate the molded shape of the outer shell 42.

Thus, in this example, the outer layer 38 of the protective padding 40 has a bent configuration such that it bends in the longitudinal direction of the leg pad $10_x$ to generally conform to the molded bent configuration of the outer shell 42. More particularly, in this example, the outer layer 38 of the protective padding 40 has a bend 79 in the longitudinal direction of the leg pad $10_x$ between the upper leg padding portion $48_1$ and the lower leg padding portion $48_3$, which corresponds to the bend 29 of the protective padding 40. The bent configuration of the outer layer 38 of the protective padding 40 may be arranged in any other suitable way in other embodiments (e.g., include any number of bends, curved or angular, disposed in any suitable manner).

In this embodiment, the outer layer 38 of the protective padding 40 generally conforms and is affixed to an outer surface 77 of the inner layer 41 of the protective padding 40. The outer surface 77 of the inner layer 41 of the protective padding 40 thus has a bent configuration such that it bends in the longitudinal direction of the leg pad $10_x$ in general conformance to the bent configuration of the outer layer 38 of the protective padding 40. More particularly, in this example, the outer surface 77 of the inner layer 41 of the protective padding 40 has a bend 78 in the longitudinal direction of the leg pad $10_x$ between the upper leg padding portion $48_1$ and the lower leg padding portion $48_3$, which corresponds to the bend 29 of the protective padding 40. The bent configuration of the outer surface 77 of the inner layer 41 of the protective padding 40 may be arranged in any other suitable way in other embodiments (e.g., include any number of bends, curved or angular, disposed in any suitable manner).

More particularly, in this embodiment, the inner layer 41 of the protective padding 40 is shaped such that the outer layer 38 of the protective padding 40, once affixed to its outer surface 77, will generally conform to the outer shell 42 (e.g., taking into account a thickness of the outer layer 38 of the protective padding 40). In this example, the inner layer 41 of the protective padding 40 is shaped by machining the padding material $89_2$ into shape. In other examples, the inner layer 41 of the protective padding 40 may be molded (e.g., compression molded) or otherwise formed using any other suitable technique.

Also, in this embodiment, the bent configuration of the outer layer 38 of the protective padding 40 is created when providing the outer layer 38 onto the outer surface 77 of the inner layer 41 of the protective padding 40. More specifically, in this embodiment, the bent configuration of the outer layer 38 of the protective padding 40 is created by thermoforming (in this case, thermobending) the outer layer 38 onto the inner layer 41 of the protective padding 40 such that the outer layer 38 generally conforms to the outer surface 77 of the inner layer 41. For instance, in this example, the outer layer 38 of the protective padding 40 is formed by heating a flat sheet of the padding material $\mathbf{89}_1$ and bending it onto the inner layer 41 of the protective padding 40 such that it generally conforms to the outer surface 77 of the inner layer 41, thereby creating the bent configuration of the outer layer 38.

In this example of implementation, the outer layer 38 and the inner layer 41 of the protective padding 40 are affixed together by being adhesively bonded together.

For instance, an adhesive may be provided between the outer layer 38 and the inner layer 41 of the protective padding 40, such as on the outer surface 77 of the inner layer 41 and/or an inner surface 99 of the outer layer 38, before the outer layer 38 is applied onto the inner layer 41. Any suitable adhesive may be used (e.g., Contact Cement™, Spray Glue, etc.). The outer layer 38 and the inner layer 41 of the protective padding 40 may be affixed together in any other suitable way in other examples of implementation (e.g., by being chemically bonded under heat, by being fastened by one or more mechanical fasteners, etc.).

With additional reference to FIGS. 22 to 25, in this embodiment, in addition to being retained between the outer shell 42 and the inner liner 44, the protective padding 40 is also laced to the outer shell 42 and/or the inner liner 40 by the lacing arrangement 14 including the laces $\mathbf{15}_1$-$\mathbf{15}_L$. More particularly, in this embodiment, the lacing arrangement 14 interacts with the protective padding 40, the outer shell 42 and the inner liner 40 to lace them together. To that end, the protective padding 40 comprises lacing openings $\mathbf{112}_1$-$\mathbf{112}_O$ that receive the lacing arrangement 14. In this example, the lacing openings $\mathbf{112}_1$-$\mathbf{112}_O$ are respectively defined by holes $\mathbf{114}_1$-$\mathbf{114}_O$ in the outer layer 38 of the protective padding 40 and holes $\mathbf{116}_1$-$\mathbf{116}_O$ in the inner layer 41 of the protective padding 40 that are aligned with corresponding ones of the holes $\mathbf{114}_1$-$\mathbf{114}_O$. In some cases, the lacing openings $\mathbf{112}_1$-$\mathbf{112}_O$ may be formed (e.g., by drilling, piercing, etc.) after the outer layer 38 and the inner layer 41 of the protective padding 40 have been assembled (e.g., to ensure that their holes $\mathbf{116}_1$-$\mathbf{116}_O$, $\mathbf{114}_1$-$\mathbf{114}_O$ align).

Also, in this embodiment, the lacing arrangement 14 comprises a lacing member 120 affixed to an inner surface 11 of the outer shell 42. More particularly, in this embodiment, the lacing member 120 comprises a band 122 and a plurality of lacing ports $\mathbf{124}_1$-$\mathbf{124}_P$ that extend laterally from the band 122 and are distributed in the longitudinal direction of the leg pad $\mathbf{10}_x$ to receive one or more of the laces $\mathbf{15}_1$-$\mathbf{15}_L$. In this example, the lacing ports $\mathbf{124}_1$-$\mathbf{124}_P$ are passed through respective ones of the lacing openings $\mathbf{112}_1$-$\mathbf{112}_O$ of the protective padding 40 and then receive one or more of the laces $\mathbf{15}_1$-$\mathbf{15}_L$ to secure the outer shell 42, the inner liner 44 and the protective padding 40 together. For instance, in this example, a lace $\mathbf{15}_i$ may be received in the lacing ports $\mathbf{124}_1$-$\mathbf{124}_P$ to secure the outer shell 42 and the protective padding 40, and another lace $\mathbf{15}_j$ extending through openings in the inner liner 44 may be received in the lacing ports $\mathbf{124}_1$-$\mathbf{124}_P$ to secure the inner liner 44 and the protective padding 40. In this case, the lacing member 120 is made of polymeric material (e.g., nylon) and adhesively bonded to the inner surface 11 of the outer shell 42. In other cases, the lacing member 120 may be configured in any other suitable manner, made of any other suitable material, and/or affixed in any other suitable way to the inner surface 11 of the outer shell 42.

Figure 15:
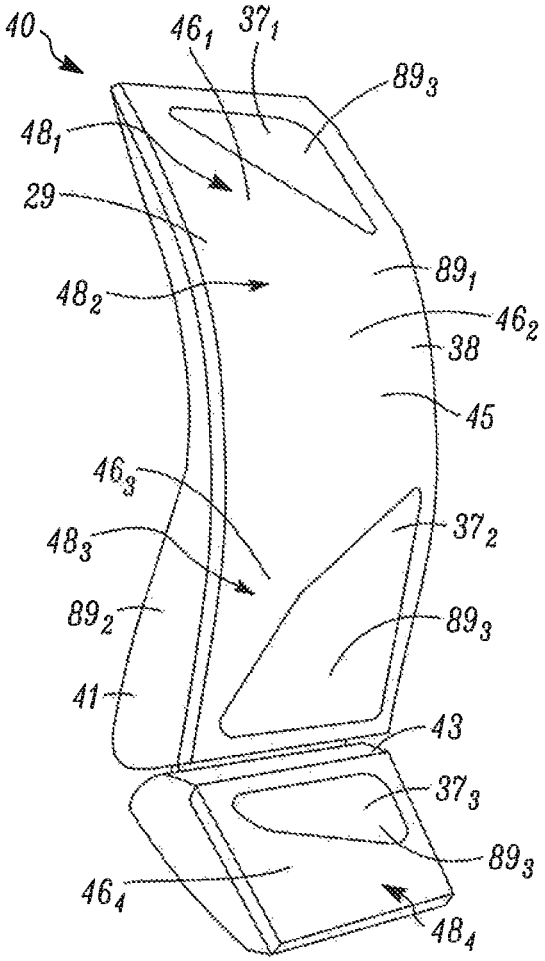
FIGS. 15 and 16 show a variant in which the protective padding comprises separate pads in accordance with another embodiment of the invention.
Figure 16:
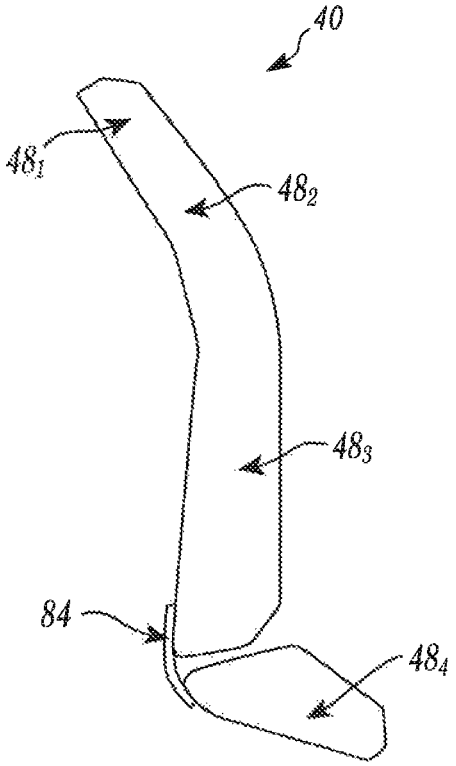

The protective padding 40 may be implemented in various other ways in other embodiments. For example, in other embodiments, the padding 40 may be made of a single shock-absorbing material (e.g., a single foam). As another example, in other embodiments, different ones of the padding portions $\mathbf{48}_1$-$\mathbf{48}_4$ may be part of distinct pads separate from one another. For instance, in some embodiments, with additional reference to FIG. 15, the foot padding portion $\mathbf{48}_4$ may be separate from the lower leg padding portion $\mathbf{48}_3$. That is, the foot padding portion $\mathbf{48}_4$ and the lower leg padding portion $\mathbf{48}_3$ may be distinct pads that are separate from one another and assembled during manufacturing of the leg pad $\mathbf{10}_x$. For example, each of the foot padding portion $\mathbf{48}_4$ and the lower leg padding portion $\mathbf{48}_3$ may be a pad molded, machined, or otherwise formed individually as a distinct piece. In some cases, a link 87 may be affixed to the foot padding portion $\mathbf{48}_4$ and the lower leg padding portion $\mathbf{48}_3$ to interconnect the foot padding portion $\mathbf{48}_4$ and the lower leg padding portion $\mathbf{48}_3$. For example, the link 84 may comprise a band stitched, adhesively bonded, or otherwise affixed to the foot padding portion $\mathbf{48}_4$ and the lower leg padding portion $\mathbf{48}_3$. In other cases, there may be no link between the foot padding portion $\mathbf{48}_4$ and the lower leg padding portion $\mathbf{48}_3$, which may be retained purely by their placement between the outer shell 42 and the inner liner 44.

The inner liner 44 faces the goalkeeper's leg $\mathbf{16}_x$ and may comprise any suitable material. For example, in this embodiment, the inner liner 44 comprises fabric 76. For instance, in some examples of implementation, the fabric of the inner liner 44 may comprise a woven fabric, a nonwoven fabric, synthetic microfibers, a synthetic woven knit, a polyurethane laminate, a mesh, or any other suitable fabric. The inner liner 44 may be implemented in various other ways in other embodiments.

The leg pads $\mathbf{10}_1$, $\mathbf{10}_2$ may be constructed in various other ways in other embodiments.

For example, in other embodiments, the leg pads $\mathbf{10}_1$, $\mathbf{10}_2$ may have any other suitable shape and/or be made of any other suitable material.

Figure 13:
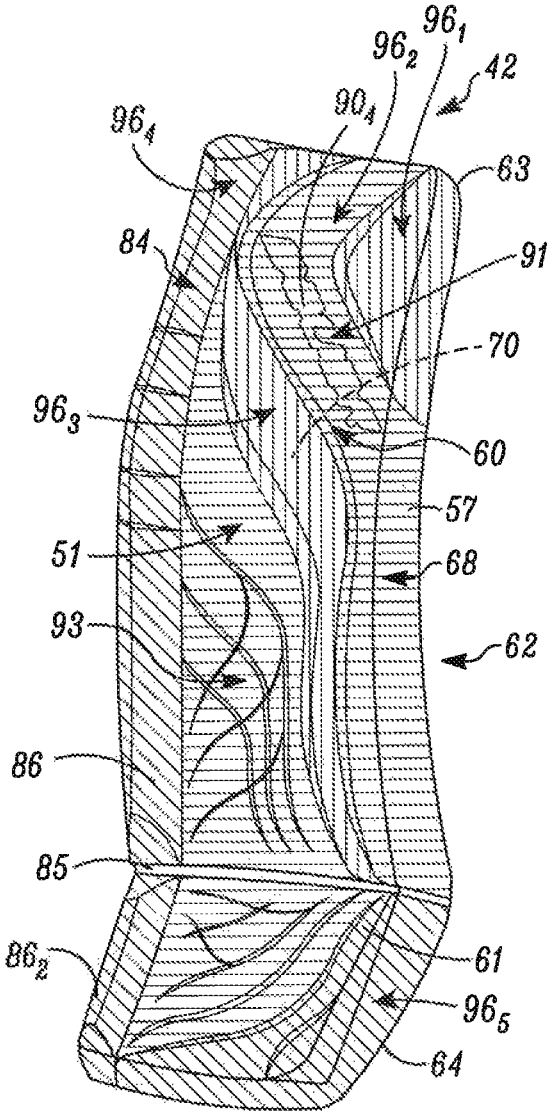
FIGS. 13 and 14 show a variant in which the molded outer shell comprises a skin affixed to a molded material in accordance with another embodiment of the invention.
Figure 14:
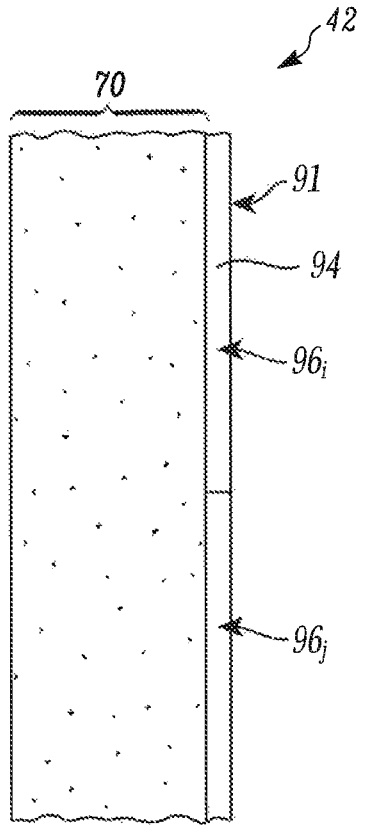

As another example, in some embodiments, with additional reference to FIGS. 13 and 14, the outer shell 42 may comprise a skin 91 bonded to the molded material 70 and constituting at least part of the outer surface 51 of the leg pad $\mathbf{10}_x$. For instance, the skin 91 may constitute at least a majority (i.e., a majority or an entirety) of the outer surface 51 of the leg pad $\mathbf{10}_x$. The skin 91 is applied on the molded material 70 after molding of the molded material 70 into the shape of the outer shell 42 and is significantly thinner than the molded material 70.

The skin 91 may be implemented in any suitable way. In this embodiment, the skin 91 comprises a layer of polymeric material 94 bonded to the molded material 70. In this example of implementation, the polymeric material 94 is polyurethane and is adhesively bonded to the molded material 70. The polymeric material 94 may be any other suitable material in other examples of implementation (e.g., polyethylene, ethylene vinyl acetate, polyvinyl chloride, etc.). In other embodiments, the skin 91 may comprise any other suitable material (e.g., a composite material such as a fiber-reinforced composite material (e.g., CURV™ composite))

More particularly, in this embodiment, the skin 91 comprises a plurality of separate pieces $\mathbf{96}_1$-$\mathbf{96}_S$ of the polymeric material 94 that are separately bonded to the molded material 70 using adhesive. For instance, in some cases, each of the separate pieces $\mathbf{96}_1$-$\mathbf{96}_S$ of the polymeric material 94 may be a sheet of the polymeric material 94. Each of the separate pieces $\mathbf{96}_1$-$\mathbf{96}_S$ of the polymeric material 94 may include an adhesive backing that can be adhesively bonded to the molded material 70. Alternatively, an adhesive may be applied between the molded material 70 and a backside of each of the separate pieces $\mathbf{96}_1$-$\mathbf{96}_S$ of the polymeric material 94 when the skin 91 is being provided on the molded material 70. In other examples of implementation, the skin 91 may be chemically bonded to the molded material 70, instead of being adhesively bonded.

In some embodiments, respective ones of the separate pieces $\mathbf{96}_1$-$\mathbf{96}_S$ of the polymeric material 94 of the skin 91 may be visually different from one another. This may facilitate provision of different designs for the outer surface 51 of the leg pad $\mathbf{10}_x$. For example, a separate piece $\mathbf{96}_i$ of the polymeric material 94 may have a different shape and/or a different coloring (i.e., a different color or set of colors) than another separate piece $\mathbf{96}_j$ of the polymeric material 94. Different designs for the outer surface 51 of the leg pad $\mathbf{10}_x$ may thus be achieved by placing different ones of the separate pieces $\mathbf{96}_1$-$\mathbf{96}_S$ of the polymeric material 94 at various locations on the molded material 70.

For instance, in some embodiments, this may facilitate personalization or customization of the outer shell 42. For example, a desired design for the outer surface of the leg pad $\mathbf{10}_x$ may be determined by the goalkeeper or another person (e.g., an equipment manager, a parent, etc.), and the separate pieces $\mathbf{96}_1$-$\mathbf{96}_S$ of the polymeric material 94 of the skin 91 may be obtained and bonded to the molded material 70 to implement the desired design. For instance, in some cases, the goalkeeper or another person may convey a request for the outer shell 42 to have the desired design to a provider of the outer shell 42 (e.g., a manufacturer of the leg pad $\mathbf{10}_x$, a distributor of the leg pad $\mathbf{10}_x$, a retailer where the leg pad $\mathbf{10}_x$ is purchasable, etc.). This request may be conveyed in any suitable manner, including in person, via telephone, or using a computer system (e.g., an online process implemented over the Internet). Upon receiving this request, the provider of the outer shell 42 provides (e.g., makes or orders) the separate pieces $\mathbf{96}_1$-$\mathbf{96}_S$ of the polymeric material 94 and places and affixes (e.g., adhesively bonds) them on the molded material 70 to create the skin 91 such as to implement the desired design. As another example, the goalkeeper or another person may purchase or otherwise obtain a kit including pieces of the polymeric material 94 (e.g., of various shapes and/or coloring) and may proceed to create the separate pieces $\mathbf{96}_1$-$\mathbf{96}_S$ of the polymeric material 94 and place and affix (e.g., adhesively bond) them on the molded material 70 to create to implement a desired design.

The skin 91 may be implemented in any other suitable way in other embodiments. For example, in some embodiments, the skin 91 may include a layer of paint or another coating applied to at least part of the molded material 70 for decoration or other purposes.

Figure 17:
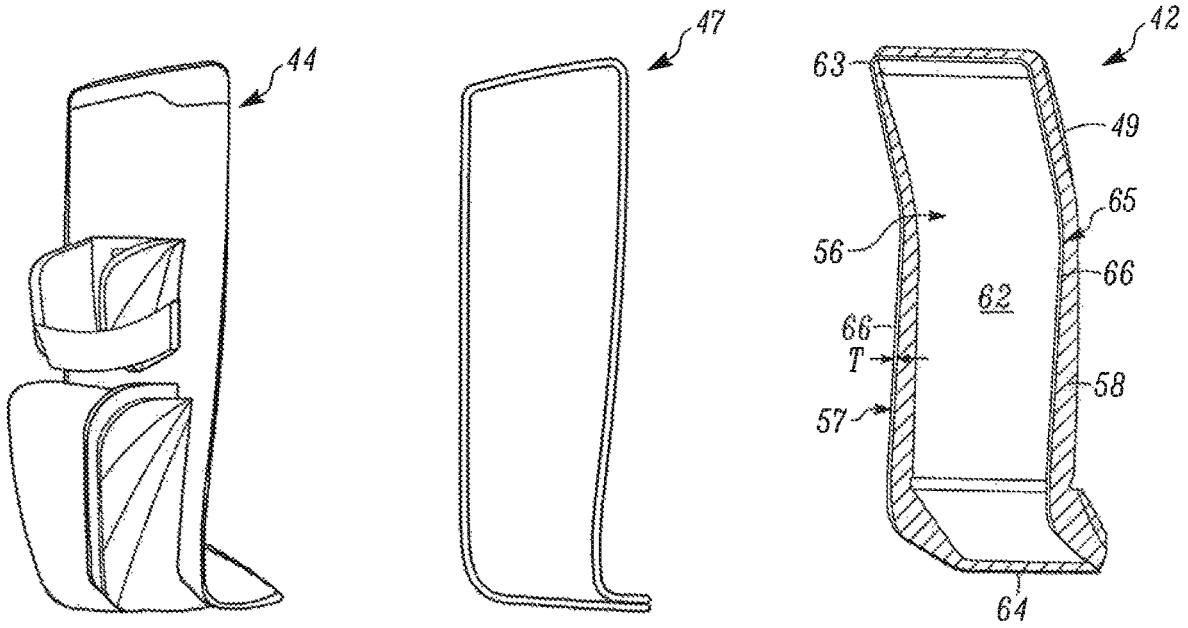
FIGS. 17 and 18 show a variant of an interconnection between the molded outer shell and an inner liner of the leg pad in accordance with another embodiment of the invention.
Figure 18:
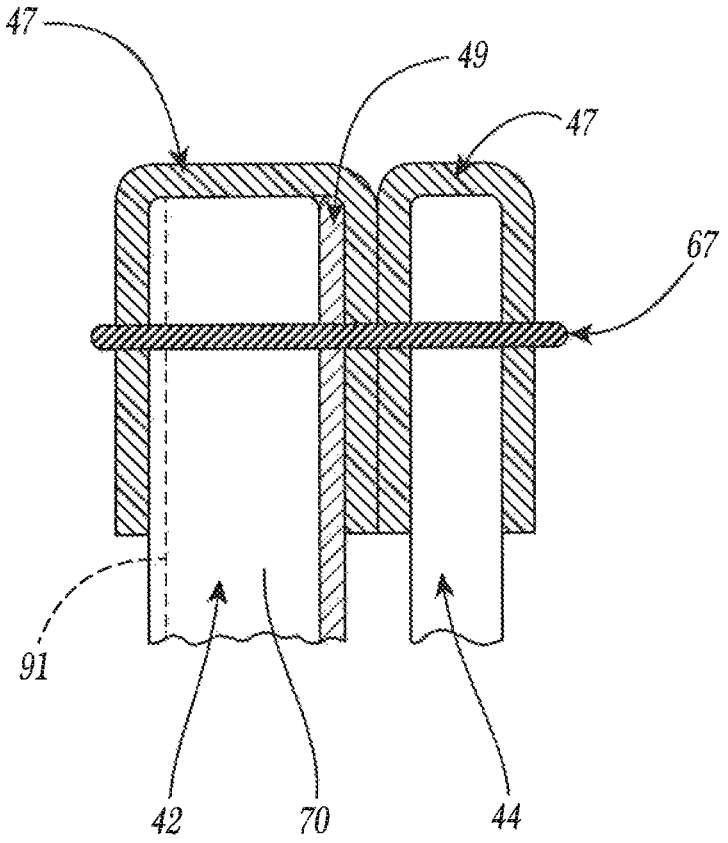

As another example, in other embodiments, the outer shell 42 and the inner liner 44 may be secured in various other ways. For instance, in some embodiments, with additional reference to FIGS. 17 and 18, the outer shell 42 may be secured to the inner liner 44 through a binding 47 that extends along at least part of a periphery of the outer shell 42 and at least part of a periphery of the inner liner 44. In this example, the binding 47 extends along a majority, in this case substantially all, of the periphery of the outer shell 42 and the periphery of the inner liner 44. The binding 47 thus extends along the fastening lip 66 of the outer shell 42 in the medial portion 57, the lateral portion 58, the top portion 63, and the bottom portion 64 of the outer shell 42. The fastener 67, in this case stitches, extends through the binding 47 and fastens the outer shell 42 and the inner liner 44 together.

The binding 47 may be implemented in any suitable way. In this embodiment, the binding 47 comprises at least one band of fabric, in this case two bands of fabric, between which are sandwiched the outer shell 42 and the inner liner 44. In this example, each band of fabric of the binding 47 is a braiding. For instance, in some examples of implementation, each band of fabric of the binding 47 may comprise a woven fabric, a nonwoven fabric, or any other suitable textile that can include fibers of any suitable material (e.g., polyester, nylon, of any other suitable material). The binding 47 may be configured in various other manners and/or made of any other suitable material in other embodiments (e.g., a band of polyurethane, rubber or another elastomer, spandex, etc.).

In this embodiment, the outer shell 42 comprises a reinforcement 49 to reinforce its fastening zone 65 where is it is fastened to the inner liner 44. More particularly, in this embodiment, the reinforcement 49 is disposed on the outer shell 42 at its fastening zone 65 beneath the binding 47. The reinforcement 49 is affixed to the molded material 70 and/or the skin 91 disposed on the molded material 70, if present, along the fastening zone 65 of the outer shell 42. The fastener 67, in this case stitches, extends through the binding 47 and the reinforcement 49 and fastens the outer shell 42 and the inner liner 44 together.

The reinforcement 49 may be implemented in any suitable way. In this embodiment, the reinforcement 49 is a reinforcing fabric layer. For example, the reinforcing fabric layer 49 may comprise a woven fabric, a nonwoven fabric, or any other suitable textile that can include fibers of any suitable material (e.g., polyester, nylon, of any other suitable material). For instance, in some cases, the reinforcing fabric layer 49 may comprise a polyester stretch mesh. The reinforcement 49 may be configured in various other manners and/or made of any other suitable material in other embodiments (e.g., polyurethane synthetic microfiber, nylon, etc.).

The reinforcement 49 may be affixed to the molded material 70 and/or the skin 91 disposed on the molded material 70, if present, in any suitable way. For example, in some embodiments, the reinforcement 49 may be adhesively bonded to the molded material 70. In other embodiments, the reinforcement 49 may be pre-laminated onto the foam layer 83 of the material 70, which may initially be provided as a foam sheet, before molding this foam sheet and this pre-laminated reinforcement together as a unit.

As another example, in other embodiments, other components of the leg pad $\mathbf{10}_x$ may be constructed using principles described above in respect of the outer shell 42.

Figure 19:
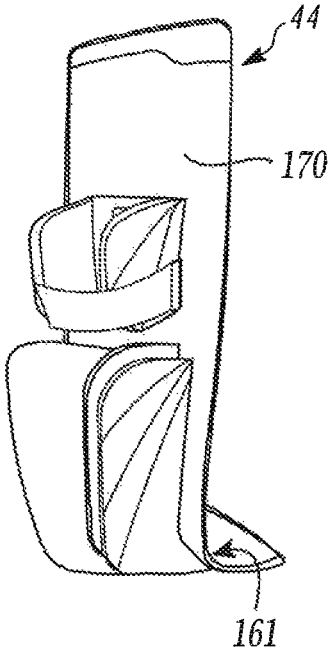
FIG. 19 shows a variant in which the inner liner is a molded inner liner in accordance with another embodiment of the invention.

For instance, in some embodiments, as shown in FIG. 19, the inner liner 44 may be a molded inner liner, i.e., may be formed by a molding process, as described above in respect of the outer shell 42. In this embodiment, a shape of the inner liner 44 is a molded shape imparted during the molding process. The inner liner 44 comprises molded material 170 that constitutes at least a majority (i.e., a majority or an entirety) of the inner liner 44 and has been formed during the molding process to impart the shape of the inner liner 44. In this example of implementation, the inner liner 44 has a molded bent configuration such that it bends in the longitudinal direction of the leg pad $\mathbf{10}_x$. For instance, in this example, the inner liner 44 includes a bend 161 in the longitudinal direction of the leg pad $\mathbf{10}_x$ between its lower leg portion and its foot portion. The molded bent configuration of the inner liner 44 may also be such that the inner liner 44 bends in the widthwise direction of the leg pad $\mathbf{10}_x$.

In embodiments where they are both molded, the outer shell 42 and the inner liner 44 may be joined together at a fastener-less joint, i.e., a joint that is stitchless (i.e., free of stitches) or otherwise free of any fastener. For example, in some embodiments, the outer shell 42 and the inner liner 44 may be joined at their joint by fusing their molded materials 70, 170 (e.g., using a "heat sealing" or other heat-based fusing process), after the protective padding 40 has been placed between them.

Figure 20:
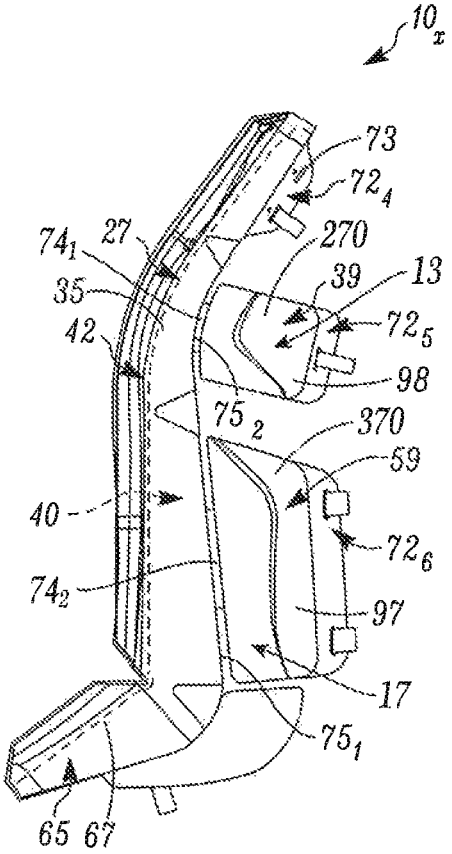
FIG. 20 shows a variant in which the leg pad comprises a molded knee wing and a molded calf wing in accordance with another embodiment of the invention.

In some embodiments, as shown in FIG. 20, the knee wing 39 and the calf wing 59 of the leg pad $\mathbf{10}_x$ may be a molded knee wing and a molded calf wing, i.e., may be formed by a molding process, as described above in respect of the outer shell 42, separately from a remainder of the outer shell 42 or even without the outer shell 42 being molded at all. In this embodiment, a shape of each of the knee wing 39 and the calf wing 59 is a molded shape imparted during the molding process. The knee wing 39 and the calf wing 59 respectively comprise molded material 270, 370 that constitutes at least a majority (i.e., a majority or an entirety) of the knee wing 39 and the calf wing 59 and has been formed during the molding process to impart the respective shape of the knee wing 39 and the calf wing 59. Notably, the molded material 270, 370 of the knee wing 39 and the calf wing 59 constitutes at least a majority (i.e., a majority or an entirety) of a respective outer surface 13, 17 of each of the knee wing 39 and the calf wing 59. The knee wing 39 and the calf wing 59 may be secured to a remainder of the leg pad 10, via fasteners $\mathbf{74}_1$-$\mathbf{74}_4$. For example, in some embodiments, the knee wing 39 and the calf wing 59 may be secured to the inner liner 44 via the fasteners $\mathbf{74}_1$-$\mathbf{74}_4$ which may comprise stitches or any other suitable fastener. In other embodiments, the knee wing 39 and the calf wing 59 may be secured to the outer shell 42 via the fasteners $\mathbf{74}_1$-$\mathbf{74}_4$.

Although in embodiments considered above the leg pads $\mathbf{10}_1$, $\mathbf{10}_2$ are designed for playing ice hockey, in other embodiments, leg pads constructed using principles described herein in respect of the leg pads $\mathbf{10}_1$, $\mathbf{10}_2$ can be hockey goalkeeper leg pads for playing roller hockey or another type of hockey (e.g., field or street hockey) on a dry playing surface (e.g., a polymeric, concrete, wooden, or turf playing surface or any other dry playing surface on which roller hockey or field or street hockey is played).

Any feature of any embodiment discussed herein may be combined with any feature of any other embodiment discussed herein in some examples of implementation.

To facilitate the description, any reference numeral designating an element in one figure has been used to designate the same element if used in any other figures. In describing the embodiments, specific terminology has been resorted to for the sake of clarity but the invention is not intended to be limited to the specific terms so selected, and it is understood that each specific term comprises all equivalents.

Unless otherwise indicated, the drawings are intended to be read together with the specification, and are to be considered a portion of the entire written description of this invention. Unless otherwise indicated, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure.

Although various embodiments and examples have been presented, this was for the purpose of describing, but not limiting, the invention. Various modifications and enhancements will become apparent to those of ordinary skill in the art and are within the scope of the invention, which is defined by the appended claims.

The invention claimed is:

1. A hockey goalkeeper leg pad for a hockey goalkeeper, the hockey goalkeeper leg pad being wearable on a leg of the hockey goalkeeper, the leg comprising a upper leg, a knee, a lower leg and a foot, the hockey goalkeeper leg pad being configured to protect the upper leg, the knee and the lower leg, the hockey goalkeeper leg pad comprising a frontal portion, a medial portion, and a lateral portion respectively configured to be positioned adjacent to a front, a medial side, and a lateral side of the leg when the hockey goalkeeper leg pad is worn on the leg, the hockey goalkeeper leg pad comprising:

a) a molded outer shell comprising an outermost surface of the hockey goalkeeper leg pad, the outermost surface of the hockey goalkeeper leg pad being configured to contact a playing surface when the hockey goalkeeper leg pad is moved on the playing surface, the molded outer shell comprising a layer of molded material defining the outermost surface of the hockey goalkeeper leg pad, the molded material comprising molded foam, the molded outer shell having a thickness;

b) an inner liner for facing the leg; and c) protective padding disposed between the molded outer shell and the inner liner, the protective padding generally conforming to the molded outer shell, wherein the thickness of the molded outer shell in a first region of the molded outer shell is different from the thickness of the molded outer shell in a second region of the molded outer shell.

2. The hockey goalkeeper leg pad of claim 1, wherein: the molded outer shell has a molded bent configuration such that the molded outer shell is bent in a longitudinal direction of the hockey goalkeeper leg pad; and the protective padding has a bent configuration such that the protective padding is bent in the longitudinal direction of the hockey goalkeeper leg pad to generally conform to the molded bent configuration of the molded outer shell.

3. The hockey goalkeeper leg pad of claim 2, wherein: the molded outer she comprises a bend in the longitudinal direction of the hockey goalkeeper leg pad between an upper leg portion of the molded outer shell and a lower leg portion of the molded outer shell over a knee portion of the molded outer shell; and the protective padding comprises a bend in the longitudinal direction of the hockey goalkeeper leg pad between an upper leg portion of the protective padding and a lower leg portion of the protective padding over a knee portion of the protective padding.

4. The hockey goalkeeper leg pad of claim 3, wherein: the bend of the molded outer shell is a curved part which defines a curvature of the molded outer shell; and the bend of the protective padding is a curved part which defines a curvature of the protective padding.

5. The hockey goalkeeper leg pad of claim 3, wherein: the bend of the molded outer shell is a first bend of the molded outer shell; the bend of the protective padding is a first bend of the protective padding; the molded outer shell comprises a second bend in the longitudinal direction of the hockey goalkeeper leg pad between the lower leg portion of the molded outer shell and a foot portion of the molded outer shell; and the protective padding comprises a second bend in the longitudinal direction of the hockey goalkeeper leg pad between the lower leg portion of the protective padding and a foot portion of the protective padding.

6. The hockey goalkeeper leg pad of claim 1, wherein the molded outer shell includes a plurality of different constituents.

7. The hockey goalkeeper leg pad of claim 6, wherein the molded foam is a first foam and the different constituents include the first foam and a second foam that is different from the first foam.

8. The hockey goalkeeper leg pad of claim 1, wherein the layer of molded material of the molded outer shell is a first layer of material, and the molded outer shell comprises a second layer of material, the second layer of material being a non-foam layer.

9. The hockey goalkeeper leg pad of claim 1, wherein the molded outer shell is a compression molded outer shell.

10. The hockey goalkeeper leg pad of claim 1, wherein the protective padding comprises a plurality of padding materials that are different from one another.

11. The hockey goalkeeper leg pad of claim 10, wherein a first one of the padding materials is a first foam and a second one of the padding materials is a second foam different from the first foam.

12. The hockey goalkeeper leg pad of claim 11, wherein the first foam is denser than the second foam.

13. The hockey goalkeeper leg pad of claim 12, wherein the second foam is disposed between the first foam and the inner liner.

14. The hockey goalkeeper leg pad of claim 10, wherein the padding materials are disposed relative to one another to control a rebound effect in different areas of the protective padding.

15. The hockey goalkeeper leg pad of claim 14, wherein a first one of the padding materials is disposed in at least one limited area of the protective padding on a second one of the padding materials to control the rebound effect in the at least one limited area of the protective padding.

16. The hockey goalkeeper leg pad of claim 15, wherein the at least one limited area of the protective padding is a plurality of limited areas of the protective padding that are spaced apart from one another.

17. The hockey goalkeeper leg pad of claim 1, wherein the protective padding comprises: a first layer including a first padding material; and a second layer including a second padding material that is stiffer than the first padding material.

18. The hockey goalkeeper leg pad of claim 17, wherein the second padding material is disposed between the molded outer shell and the first padding material.

19. The hockey goalkeeper leg pad of claim 1, wherein the molded outer shell comprises an ornament.

20. The hockey goalkeeper leg pad of claim 19, wherein the ornament is a molded ornament.

21. The hockey goalkeeper leg pad of claim 19, wherein the ornament is configured to convey information to a viewer.

22. The hockey goalkeeper leg pad of claim 19, wherein the ornament has a height of at least 1.5 mm.

23. The hockey goalkeeper leg pad of claim 21, wherein the ornament has a height of at least 3 mm.

24. The hockey goalkeeper leg pad of claim 21, wherein the ornament has a height of at least 5 mm.

25. The hockey goalkeeper leg pad of claim 21, wherein the ornament has a height of at least 7 mm.

26. The hockey goalkeeper leg pad of claim 1, wherein the outermost surface of the hockey goalkeeper leg pad comprises a recess.

27. The hockey goalkeeper leg pad of claim 1, wherein the outermost surface of the hockey goalkeeper leg pad comprises a projection.

28. The hockey goalkeeper leg pad of claim 1, wherein the outermost surface of the hockey goalkeeper leg pad comprises a rib.

29. The hockey goalkeeper leg pad of claim 1, wherein the first region of the molded outer shell and the second region of the molded outer shell are free of fabric overlay.

30. The hockey goalkeeper leg pad of claim 1, wherein the molded outer shell comprises a cavity receiving and holding the protective padding.

31. The hockey goalkeeper leg pad of claim 1, wherein: the outermost surface of the hockey goalkeeper leg pad comprises a plurality of ornaments; each ornament is one of a projection, a recess and a rib; and the outermost surface of a cross section of the hockey goalkeeper leg pad orthogonal to a longitudinal direction of the hockey goalkeeper leg pad is flat between the ornaments.

32. A hockey goalkeeper leg pad for a hockey goalkeeper, the hockey goalkeeper leg pad being wearable on a leg of the hockey goalkeeper, the leg comprising a upper leg, a knee, a lower leg and a foot, the hockey goalkeeper leg pad being configured to protect the upper leg, the knee and the lower leg, the hockey goalkeeper leg pad comprising a frontal portion, a medial portion, and a lateral portion respectively configured to be positioned adjacent to a front, a medial side, and a lateral side of the leg when the hockey goalkeeper leg pad is worn on the leg, the hockey goalkeeper leg pad comprising:

a) a molded outer shell comprising an outermost surface of the hockey goalkeeper leg pad, the outermost surface of the hockey goalkeeper leg pad being configured to contact a playing surface when the hockey goalkeeper leg pad is moved on the playing surface, the molded outer shell comprising a layer of molded material defining the outermost surface of the hockey goalkeeper leg pad, the molded material comprising molded foam, the molded outer shell having a thickness;

b) an inner liner for facing the leg; and c) protective padding disposed between the molded outer shell and the inner liner, the protective padding generally conforming to the molded outer shell, wherein: the thickness of the molded outer shell in a first region of the molded outer shell is different from the thickness of the molded outer shell in a second region of the molded outer shell; and at least part of the outermost surface of the hockey goalkeeper leg pad is flat in a cross section of the hockey goalkeeper leg pad orthogonal to a longitudinal direction of the hockey goalkeeper leg pad.

33. A hockey goalkeeper leg pad for a hockey goalkeeper, the hockey goalkeeper leg pad being wearable on a leg of the hockey goalkeeper, the leg comprising a upper leg, a knee, a lower leg and a foot, the hockey goalkeeper leg pad being configured to protect the upper leg, the knee and the lower leg, the hockey goalkeeper leg pad comprising a frontal portion, a medial portion, and a lateral portion respectively configured to be positioned adjacent to a front, a medial side, and a lateral side of the leg when the hockey goalkeeper leg pad is worn on the leg, the hockey goalkeeper leg pad comprising:

a) a molded outer shell comprising an outermost surface of the hockey goalkeeper leg pad, the outermost surface of the hockey goalkeeper leg pad being configured to contact a playing surface when the hockey goalkeeper leg pad is moved on the playing surface, the molded outer shell comprising a first molded layer comprising foam and a second non-foam layer molded with the first molded layer and defining the outermost surface of the hockey goalkeeper leg pad, the molded outer shell having a thickness;

b) an inner liner for facing the leg; and c) protective padding disposed between the molded outer shell and the inner liner, the protective padding generally conforming to the molded outer shell, wherein: the thickness of the molded outer shell in a first region of the molded outer shell is different from the thickness of the molded outer shell in a second region of the molded outer shell.

* * * * *